US009940781B2

(12) United States Patent
Saravanan et al.

(10) Patent No.: US 9,940,781 B2
(45) Date of Patent: Apr. 10, 2018

(54) RECORDING AND REPRODUCTION OF WAGERING GAME PLAY STEP EVENTS OCCURING IN MULTIPLE NESTED BONUS GAMES

(71) Applicant: BALLY GAMING, INC., Las Vegas, NV (US)

(72) Inventors: Saravanan Saravanan, Chennai (IN); Kevin C. Johnson, Chicago, IL (US); Gary J. Oswald, Elk Grove Village, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 287 days.

(21) Appl. No.: 14/865,088

(22) Filed: Sep. 25, 2015

(65) Prior Publication Data

US 2017/0092058 A1 Mar. 30, 2017

(51) Int. Cl.
*G07F 17/32* (2006.01)

(52) U.S. Cl.
CPC ..... *G07F 17/3227* (2013.01); *G07F 17/3211* (2013.01); *G07F 17/3213* (2013.01); *G07F 17/3267* (2013.01); *G07F 17/3286* (2013.01)

(58) Field of Classification Search
CPC ..... G07F 17/3227; G07F 17/3211; G07F 17/3213
USPC ..... 436/20
See application file for complete search history.

(56) References Cited

U.S. PATENT DOCUMENTS 7,387,571 B2 6/2008 Walker et al. ..... 463/26
7,887,404 B2 2/2011 Saffari et al. ..... 463/16
8,684,818 B2 4/2014 Meyer ..... 463/20
8,795,068 B2 8/2014 Belger et al. ..... 463/25
8,814,648 B2 8/2014 Baerlocher et al. ..... 463/16
(Continued)

FOREIGN PATENT DOCUMENTS

EP 1296294 A2 3/2003 ..... G06F 17/32

OTHER PUBLICATIONS

"230 Illinois Compiled Statutes (ILCS) 40/5: Video Gaming Act, Article 5", printed Aug. 14, 2015, retrieved from "http://www.ilga.gov/legislation/ilcs/ilcs5.asp?ActID=3095&Chapter" (16 pages).
(Continued)

*Primary Examiner* — Omkar Deodhar
*Assistant Examiner* — Shauna-Kay Hall
(74) *Attorney, Agent, or Firm* — David J. Bremer

(57) ABSTRACT

A gaming system includes game-logic circuitry that primarily performs a casino wagering game. The casino wagering game includes gaming events (play steps) having outcomes that may trigger and perpetuate a multi-level bonus game. As the wagering game is performed, a game cycle data record is created containing game cycle data related to the outcome of the play steps. A predetermined number of the most recent game cycle data records are stored in non-volatile memory. Each game cycle data record includes a predetermined number of play step data records for the base-game, bonus-game-triggering, and bonus-game play steps, as performed in chronological order. When the predetermined number of play step data records is exceeded, the oldest non-triggering play step data record is removed from the game cycle data and accrued into summary data specific to a nested-depth of the play step for the game cycle.

20 Claims, 13 Drawing Sheets

(56) References Cited

U.S. PATENT DOCUMENTS

| | | | | |
|---|---|---|---|---|
| 9,129,489 | B2 | 9/2015 | Froy et al. | |
| 2008/0026832 | A1* | 1/2008 | Stevens | G07F 17/32 463/26 |
| 2011/0269548 | A1* | 11/2011 | Barclay | G07F 17/32 463/42 |
| 2012/0046111 | A1 | 2/2012 | Walker et al. | 463/42 |
| 2012/0289322 | A1* | 11/2012 | Causley | G07F 17/3269 463/26 |
| 2013/0116030 | A1 | 5/2013 | Jacobson | 463/16 |
| 2013/0210512 | A1* | 8/2013 | Meyer | G07F 17/3269 463/16 |
| 2014/0295949 | A1 | 10/2014 | Miltenberger et al. | 463/25 |
| 2015/0133210 | A1 | 5/2015 | Trotter et al. | 463/29 |
| 2015/0213681 | A1 | 7/2015 | Arnone et al. | |
| 2015/0251093 | A1* | 9/2015 | Trombetta | A63F 13/49 463/24 |

OTHER PUBLICATIONS

Screen shot from WMS game "Diamond Hunt", 2014 (1 page).
Gaming Laboratories International, LLC, "Technical Standards for Video Gaming Terminals in Illinois Version 1.3: Chapter 2 'Software Requirements'", Mar. 5, 2012 (20 pages).

* cited by examiner

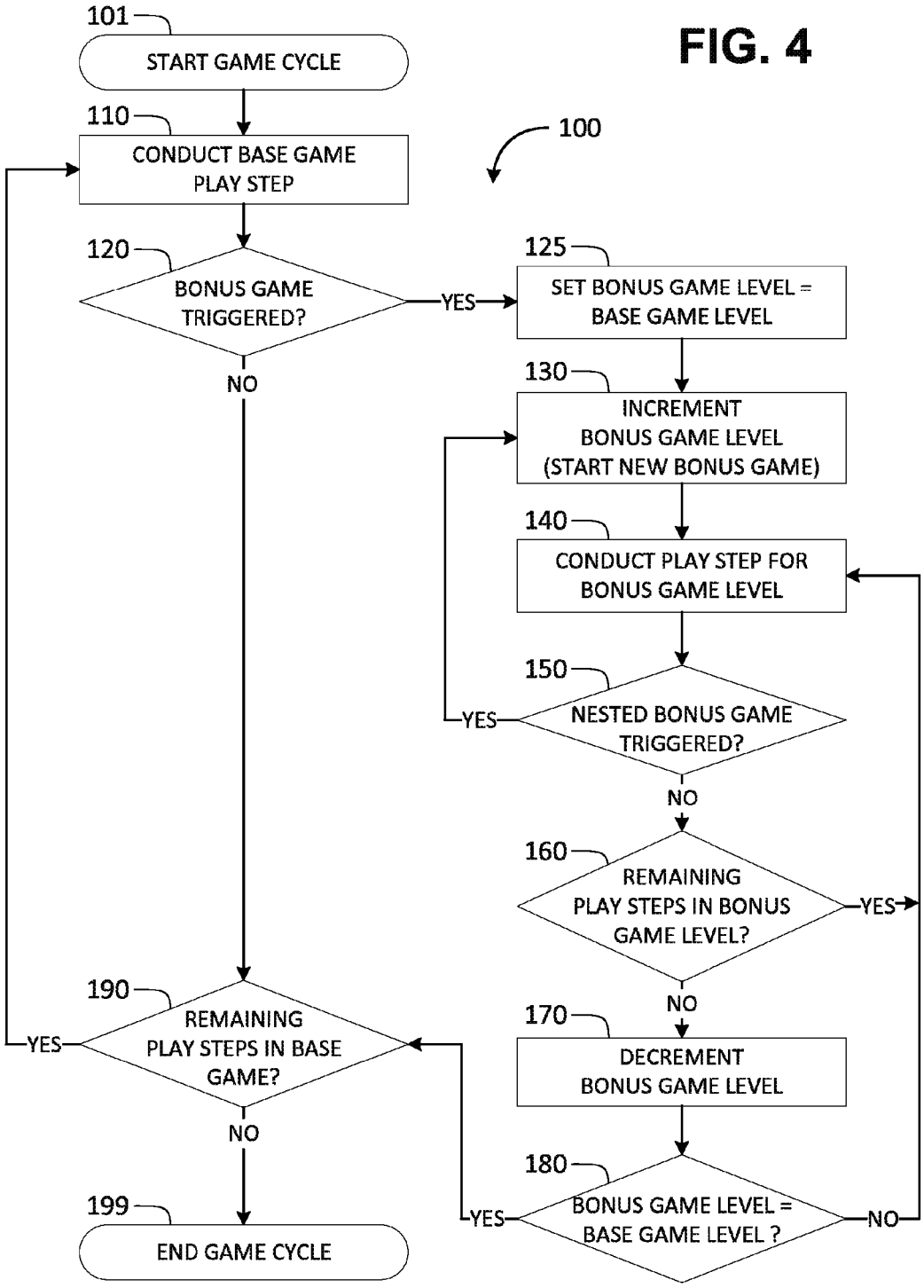
FIG. 4
100
101
START GAME CYCLE
110
CONDUCT BASE GAME PLAY STEP
120
BONUS GAME TRIGGERED?
YES
NO
125
SET BONUS GAME LEVEL = BASE GAME LEVEL
130
INCREMENT BONUS GAME LEVEL (START NEW BONUS GAME)
140
CONDUCT PLAY STEP FOR BONUS GAME LEVEL
150
NESTED BONUS GAME TRIGGERED?
YES
NO
160
REMAINING PLAY STEPS IN BONUS GAME LEVEL?
YES
NO
170
DECREMENT BONUS GAME LEVEL
180
BONUS GAME LEVEL = BASE GAME LEVEL ?
YES
NO
190
REMAINING PLAY STEPS IN BASE GAME?
YES
NO
199
END GAME CYCLE

201
START SPIN
200

210
SPIN AND STOP REELS
220
PROGRESSIVE AWARD TRIGGERED?
YES
230
PROGRESSIVE AWARD CELEBRATION
NO
240
BIG WIN?
YES
250
BIG WIN CELEBRATION
NO
260
BONUS GAME TRIGGERED?
YES
270
BONUS GAME ALREADY ACTIVE?
YES
NO
NO
280
START NEW BONUS GAME
290
ADD BONUS GAME SPINS
299
END SPIN 1000
1001
START
1010
PERFORM PLAY STEP?
NO
1099
END
YES
1020
CONDUCT PLAY STEP
1030
BONUS TRIGGER?
NO
YES
1040
STORE PLAY STEP DATA
1050
PREDETERMINED NUMBER OF STORED PLAY STEPS EXCEEDED?
NO
YES
1060
DETERMINE OLDEST NON-TRIGGERING PLAY STEP DATA (ONTPSD) STORED IN MEMORY
1070
ACCRUE ONTPSD INTO SUMMARY DATA RECORD FOR ONTPSD LEVEL
1080
REMOVE ONTPSD FROM MEMORY 1100
1101
START
1110
SET LEVEL TO BASE LEVEL (DISPLAYS DATA FOR BASE LEVEL AND ALL SUB-LEVELS)
1120
DISPLAY SUMMARY RECORD FOR LEVEL, IF ANY
1130
DISPLAY NEXT PLAY STEP FOR LEVEL, IF ANY
1140
IS THE DISPLAYED PLAY STEP A BONUS TRIGGER?
YES
1150
INCREMENT LEVEL (NEW BONUS GAME)
NO
1160
REMAINING PLAY STEPS FOR LEVEL?
YES
NO
1170
DECREMENT LEVEL
1180
LEVEL < BASE LEVEL ?
NO
YES
1199
END

RECORDING AND REPRODUCTION OF WAGERING GAME PLAY STEP EVENTS OCCURING IN MULTIPLE NESTED BONUS GAMES

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to recording and maintaining gaming events for subsequent reporting and/or reproduction.

BACKGROUND OF THE INVENTION

The wagering gaming industry is often subject to jurisdictional regulations that require recordation of various gaming events for future playback, examination, reporting, and/or verification. For example, the play history of a wagering game (e.g., game outcome, intermediate play steps, credits available, bets placed, credits paid, credits cashed out, etc.) for a predetermined number of most recent games may be mandated by one or more jurisdictional regulations. For each game play history, a jurisdiction may additionally mandate storing a predetermined number of the most recent intermediate play step event results along with the game outcome.

In some cases, a single game event may trigger a large number of subsequent events to be performed (e.g., a large number of free spins are granted at once, several bonus games are concurrently triggered, a bonus game is triggered within another bonus game, etc.). Electronic gaming machines (EGMs) have a finite (and relatively small) amount of non-volatile random-access memory for saving game histories and game play steps. As the number of play steps increases for a particular game history, a loss of data relating to bonus game triggering events may occur.

Thus, when examining or reviewing the stored game event data when very large numbers of play steps occur and/or concurrent or nested bonus games are being performed, there may be a considerable loss of contextual information for subsequent play steps of the wagering game during playback. An improved process and methodology for effectively logging and storing chronological event information for game cycles is needed that maintains contextual information related to subsequent gaming events. Further, the ability to record and maintain information providing context for large numbers of gaming events (particularly in nested bonus games), in addition to maintaining game play information and outcomes for display, may be very helpful for facilitating disputes of gameplay made by the player and/or game operator after the game has completed.

SUMMARY OF THE INVENTION

According to one aspect of the invention, a computer-implemented method for operating a gaming system is disclosed. The gaming system includes game-logic circuitry and a regulated gaming machine primarily dedicated to playing at least one casino wagering game. The gaming machine includes an electronic display device and one or more electronic input devices. The method detects a physical item associated with a monetary value that establishes a credit balance via an electronic input device of the gaming machine. The game-logic circuitry initiates a base game of the casino wagering game in response to an input indicative of a wager covered by the credit balance. In response to a base-game triggering event during the base game, the game-logic circuitry conducts a multi-level bonus game including a plurality of played levels. The plurality of played levels include a main level and a plurality of nested levels each including one or more play steps. At least one of the play steps in the main level is a first bonus-game triggering step that triggers one of the nested levels, and at least one of the play steps is a second bonus-game triggering step that triggers another of the nested levels. In response to a total number of play steps exceeding a predetermined number, the game-logic circuitry stores summary data and play step replay data in a memory device. The summary data enables display of a summary screen for each of the nested levels. The play step replay data enables display of the outcome of the first bonus-game triggering step, the second bonus-game triggering step, and the predetermined number of the play steps. The method concludes by receiving a cashout input that initiates a payout from the credit balance via at least one of the one or more electronic input devices.

According to another aspect of the present invention, a gaming system comprises game-logic circuitry and a regulated gaming machine primarily dedicated to playing at least one casino wagering game. The gaming machine includes an electronic display device and one or more electronic input devices, and may be incorporated into a single, freestanding gaming machine. The game-logic circuitry is configured to detect a physical item associated with a monetary value that establishes a credit balance via at least one of the one or more electronic input devices, and initiate the casino wagering game in response to an input indicative of a wager covered by the credit balance. In response to a base-game triggering event during the base game, a multi-level bonus game of the casino wagering game is conducted including a plurality of played levels. The plurality of played levels include a main level and a plurality of nested levels, and each of the played levels include one or more play steps. At least one of the play steps in the main level is a first bonus-game triggering step that triggers one of the nested levels, and at least one of the play steps in the main level or the one of the nested levels is a second bonus-triggering step that triggers another of the nested levels. In response to a total number of play steps exceeding a predetermined number, summary data and play step replay data is stored in a memory device. The play step replay data enables display of the outcome of the first bonus-game triggering step, the second bonus-game triggering step, and the predetermined number of the play steps, and the summary data enables display of a summary screen for each of the nested levels. A cashout input is received via at least one of the one or more electronic input devices that initiates a payout from the credit balance.

According to another aspect of the present invention, a gaming system comprises a regulated gaming machine and game-logic circuitry. The gaming system may be incorporated into a single, freestanding gaming machine having an electronic display device and one or more electronic input devices, and is primarily dedicated to playing at least one casino wagering game. The game-logic circuitry is configured to detect a physical item associated with a monetary value that establishes a credit balance via an electronic input device of the gaming machine. The casino wagering game is initiated in response to an input indicative of a wager covered by the credit balance. In response to a base-game triggering event during the base game, a multi-level bonus game of the casino wagering game is conducted. The bonus game includes a plurality of played levels including a main level and a plurality of nested levels. Each of the played levels includes one or more play steps. Each of the nested levels is triggered by a respective bonus-triggering step among the one or more play steps in the main level or another of the nested levels. In response to a total number of play steps exceeding a predetermined number, summary data and play step replay data is stored in a memory device. The play step replay data enables display of the outcome of each bonus-game triggering step and the predetermined number of the last chronological play steps played in the bonus game. The summary data enables display of a summary screen for each of the played levels. The play step replay data and summary data may then be retrieved from the memory device to reproduce and display the outcome of each bonus-game triggering step and the predetermined number of the play steps, and display the summary screen for each of the nested levels. That is, the electronic display device generates and displays the outcome of the bonus-game triggering steps and the play steps of the bonus game based upon the replay data, and the summary screen for each of the nested levels. A cashout input is received that initiates a payout from the credit balance via at least one of the one or more electronic input devices.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4 is a flowchart for a process for performing various steps of a casino wagering game having nested bonus games, according to an embodiment of the present invention.

Figure 1:
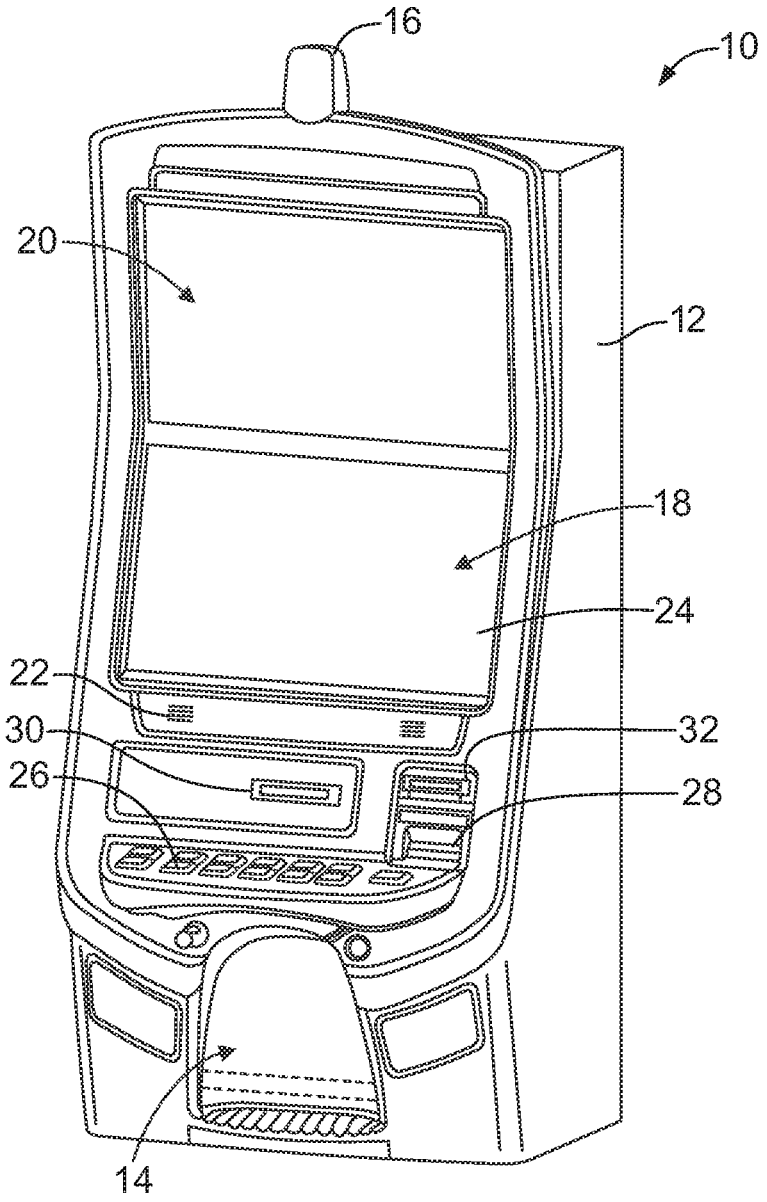
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring now to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
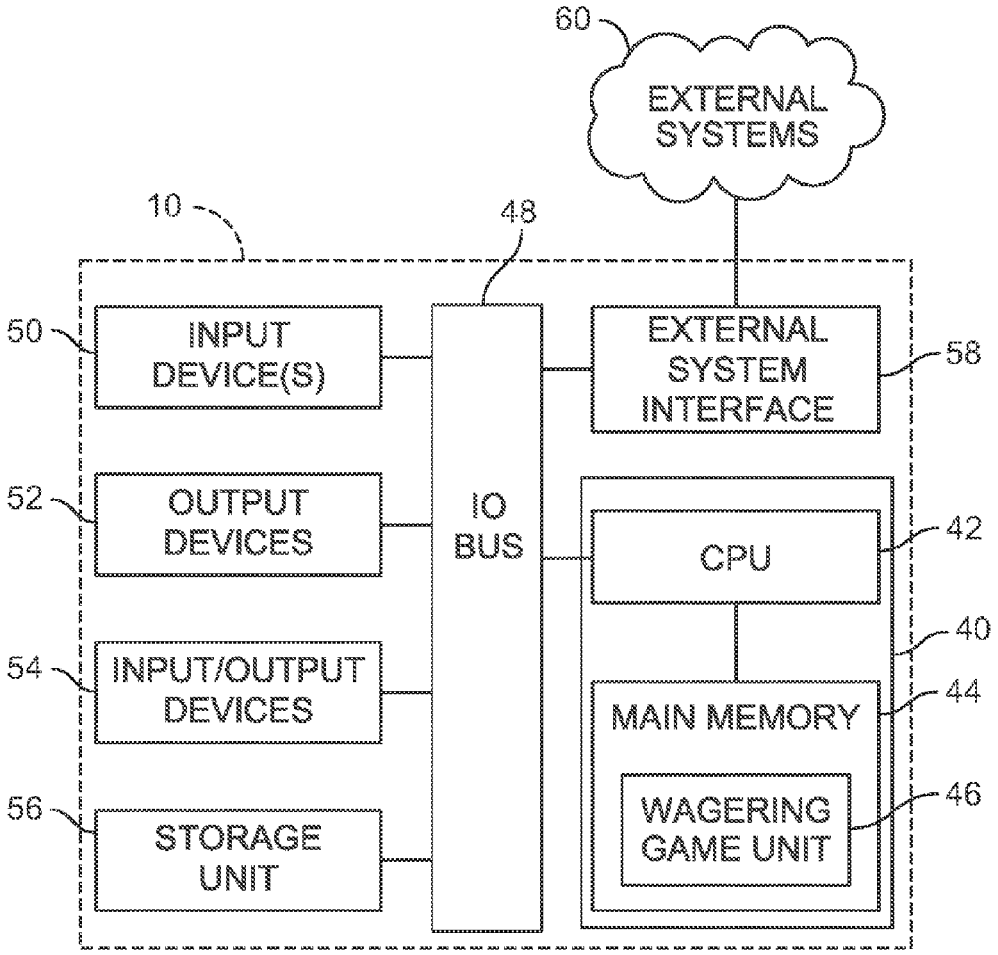
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different regional locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
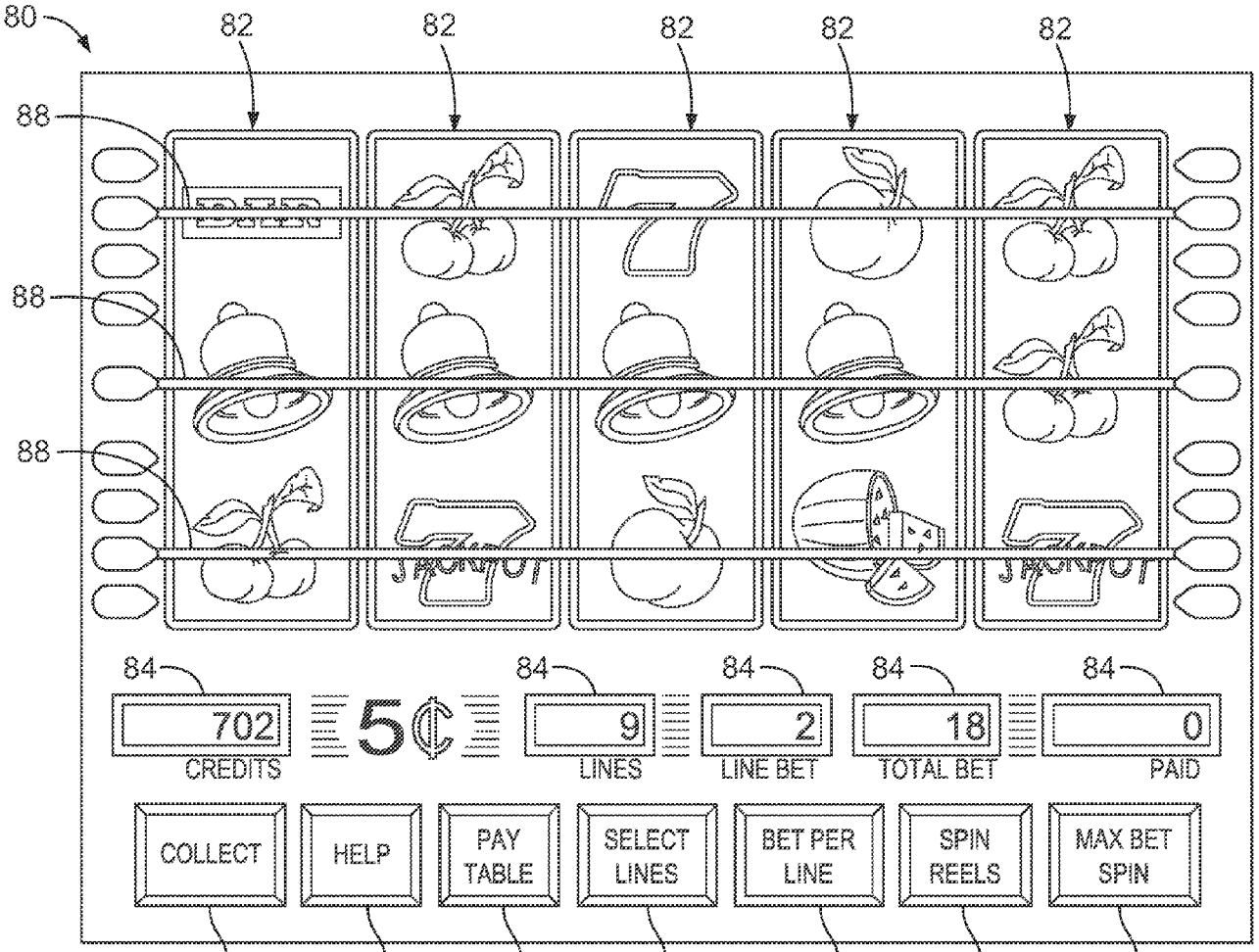
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Each time a wager is made, a game cycle is initiated. Sometimes, a game cycle may be called a game instance, beginning upon an actuation by a player indicating placement of a wager. A game cycle will include deduction of a credit amount from a credit meter corresponding to a wager amount and performing an associated wagering game operation to determine the outcome of the wager. A game cycle is considered completed when a final transfer to the player's credit meter takes place or when all credits wagered or won that have not been transferred to the credit meter are lost. A game cycle may be considered to be "wager-to-wager", including all play step events occurring between wagers that impact game play, winning combinations, monetary returns, etc. A game comprising a single game cycle may include games that trigger a free game feature and any subsequent free games, "second screen" bonus feature(s), games with player choices (e.g., Draw Poker, Blackjack, Pick Fields), games allowing additional credit wagers (e.g., Blackjack insurance, increasing stakes), "double-up" gambling features allowing a player to risk winnings for a double-or-nothing pay-off, etc.

In one embodiment, a game cycle consists of any additional free spins or play steps of triggered bonus and sub-bonus games. A game cycle may conclude with or without a special feature, a bonus game, or other type of intermediate play step being triggered. An intermediate play step refers to a gaming event having a trigger perceived by a player (e.g., a bonus game event like a free spin or selection of indicia) and an associated perceived outcome of the trigger. An intermediate play step may be initiated by the player or the gaming device.

When a special feature is triggered during a game cycle, details of the feature (including parameters, results, etc.) may be stored for later inspection and/or accounting. In the event that a bonus game is triggered, one or more intermediate play steps may be performed as a result. For example, a bonus game invokes a free spin granted on a particular set of reels, a spin of a video or physical wheel is performed, etc. Events within a bonus game may also include the triggering of one or more additional sub-bonus game(s) that require additional intermediate play steps to be performed in the game cycle. These nested bonus games are sometimes considered "children" bonus games to the triggering "parent" bonus games. The triggering of nested bonus games and additional sub-bonus games may occur during the base game, a main bonus game, or another of the nested bonus games.

Different jurisdictions may mandate different requirements for recording and maintaining game cycle data and associated play step data. For example, the regulations of a specific jurisdiction may require digital storage of the most recent twenty-five game cycles in non-volatile random-access memory (NVRAM) memory such that particular game cycle data may be accessed for later inspection or playback. NVRAM is utilized so game cycle data is maintained even in the event of an interim power failure. Further, regulations may require that game cycle data must include the most recent fifty play steps of the game cycle.

Thus, due to limited memory constraints and large numbers of intermediate play step events, some information is not maintained in many cases. In cases where the number of intermediate play steps is below a predetermined amount threshold, all the play steps are stored as part of the game cycle data. However, when the number of intermediate play steps exceeds the given threshold, information relating to earlier play steps may not be persistently maintained and may be removed from the information stored for a given game cycle. In many instances, older play step event data (regardless of the type of event) is purged from memory to make room for more recent event information. The dropped play step data may include bonus-game triggering events or other events that provide specific context to one or more upcoming events. For example, a gaming machine regulated to store the most recent fifty intermediate play steps in each game cycle may include an intermediate play step awarding two-hundred free spins in a bonus game causing the triggering play step to be missing upon conclusion of the game cycle. Further, a gaming machine providing large numbers of intermediate play spins in multiple bonus games (either nested or simultaneous) may result in large amounts of contextual and trigger-related play step data to be lost in the game cycle data for a given game cycle.

The inclusion of nested bonus games (i.e., bonus games performed within bonus games, bonus games triggering sub-bonus games, as a result of multiple bonus games triggered in the base game, etc.) may result in a large amount of individual intermediate play step data in addition to other game cycle specific data. Resultantly, the game cycle data may far exceed (physical or specified) storage limits set for maintaining game cycle data in accordance with regulations. Further, nested bonus games (i.e., "child" bonus games triggered by a play step within a "parent" bonus game or the base game) require an enhanced method for maintaining and efficiently storing the game cycle data in accordance with any jurisdictional regulations specific to a wagering machine in a particular region.

Sometimes nested bonuses are "flattened" into a single summary screen (thereby treating a parent bonus game and all child bonus games as a single bonus game). This may fail to provide the necessary detail for categorization and accurate summary of any distinct bonus and sub-bonus games conducted within. In one embodiment, a process is described for better characterizing the history, playback, and results summary of base games, bonus games, and sub-bonus games of a game cycle. A summary is generated for each bonus game nested-depth (i.e., game level), including separate summary screens for each bonus-game level, if necessary. Further, a single summary screen may be presented that merges multiple summary screens into a condensed summary screen while maintaining the modular mature of the distinct summary screens.

Summary screens displayed to a player and/or a gaming administrator are generated by formatting and displaying summary data for the game cycle on an output device. The summary data stored for each game cycle may be very comprehensive and may include all information contained in the individual play step data for each and every play step. The summary data may include accrued amounts of various attributes spanning some or all of the play steps. For example, summary data may include a number of play steps awarded for a specific bonus game, a number of play steps performed for the bonus game, a number of summarized play steps contributing to the accrued summary data, a number of credits awarded during the summarized play steps, an accumulated tally of the number of winning lines in the bonus game and/or summarized play steps, an accumulated amount of credits won in the bonus game and/or summarized play steps, the amount of progressive money won during the bonus game and/or summarized play steps, a number of additional spins awarded during the bonus game and/or summarized play steps, a number of indicia selected during one, some or all of the play steps of the bonus game and/or summarized play steps, the location on the display device of any player-selected indicia, the random numbers used to generate an outcome for a play step of the bonus game and/or summarized play steps, a representation of the outcome of the play steps of the bonus game and/or summarized play steps (symbolic and/or graphical), the stop values for rotatable reels (virtual or physical) specifying displayed symbols of an outcome, etc. In short, any information implemented during the generation and display of a single play step, a series of play steps, or all play steps for a nested-depth bonus game level may be reflected in summary data of a game cycle, and resultantly, in one or more summary screens displayed to a player and/or system administrator.

Further, plural summary data records may be combined into a single summary data record and/or a single summary screen for display. For example, a single summary screen may include multiple simultaneously displayed regions corresponding to different nested-depth bonus game levels, play steps, and/or game cycles. Displayed summary screens may also relate to a specific bonus game, bonus game nested-depth level, set of play steps, or game cycle.

In one embodiment, game cycle data is implemented to enable an accurate display and playback of all bonus game triggering play steps, providing context to nested bonus-game initiations for each game cycle. In one embodiment, information relating to a set of gaming cycles is digitally recorded and maintained. The gaming cycle data includes a corresponding plurality of nested bonus-game-triggering events, result summaries, and a predetermined number of the most recently performed play steps of the game cycle. The stored game cycle data may be used for accounting reporting and/or reproduction of the results, outcomes, and contextual triggering steps for all of the nested bonus games in each gaming cycle.

In one embodiment, the invention stores game cycle data for each of a series of recent and consecutive game cycles such that play step events recorded for the game cycles may be duplicated using a replay operation performed by the gaming machine. The game cycle data enables the gaming machine (or a remote terminal) to perform the replay operation to display the outcome result of each stored play step in the game cycle, and/or regenerate or reproduce the graphical animation originally presented to the player during the initial play step display during the game cycle. Additionally, the game cycle data may include summary data for the game cycle as a whole, including a summary of results for play steps not explicitly stored in the game cycle data. The game cycle data may include one or more types of information that may be used to report play step outcome results, for example display device screenshots showing the play step outcome, sets of values for visually regenerating the play step outcome, random number(s) relied upon to determine a play step outcome, etc.

Referring now to FIG. 4, a process 100 is illustrated for broadly describing the conducting of a casino wagering game having nested bonus games in one embodiment. The process 100 begins when the game cycle is initiated in step 101 for a wagering game using rotating symbol-bearing reels similar to FIG. 3. A game cycle instance may be considered to begin when a wager is placed and the game is formally initiated (e.g., actuating the "spin reels" button). Placing of the wager may include a deduction of credits, funds, or other currency from the balance of a credit meter to reflect the wager covered by the credit balance.

In step 110, the base game is conducted. In one embodiment, random numbers are generated and a set of reels are spun and stopped to reveal outcome symbols corresponding to a set of reel stop values derived from one or more of the random numbers. One or more of the outcome symbols may trigger a bonus game. In one embodiment, a combination of the outcome symbols meeting a predetermined criteria trigger a bonus game. In another embodiment, a combination of the outcome symbols meeting a predetermined criteria trigger a bonus game and a nested bonus game. In another embodiment, a set of randomly generated overlay graphical symbols appear on the outcome symbols, triggering a bonus game corresponding to a predetermined combination criteria of overlay symbols. In yet another embodiment, a combination of the outcome symbols and the overlay symbols may trigger a bonus game.

In one embodiment, an additional nested bonus game may be triggered by a specific combination of symbols (outcome and/or overlay) and/or other events that occur during the base game, or an ongoing bonus game. Further, an additional nested bonus game may be triggered during a nested bonus game. In one embodiment, triggered bonus games corresponding to bonus games already in progress (e.g., a "parent" bonus game or a parallel bonus game concurrently in progress, or a bonus game pending initiation), may result in additional instances or granted play steps (e.g., free-spins) for the corresponding bonus game.

In step 120, a determination is made as to whether a bonus game is triggered by the outcome of the base game play step (at the main level or "base" level of the wagering game). The bonus game may be (or become) a multi-level bonus game having multiple bonus-game levels performed in parallel (simultaneously), independently, co-dependently, and/or in a hierarchal fashion (nested). The type(s) of bonus game(s) may be determined by the player directly from the outcome of the base game, by additional random numbers and associated presentations, or a selective combination of these.

In step 125, a "bonus-game level" (BGL) is created and assigned a value equal to the base-game level of the base game. The BGL is used to track the nested depth of each bonus game, having a value corresponding to the nested depth of the associated bonus game. The BGL is also used in combination with a counter to determine when an associated number of play steps for a nested-depth bonus game have been completed. Subsequent "child" bonus games have a corresponding (incremented) BGL value, assigned as each bonus game and nested bonus game are triggered. The value of the BGL is constant for each of the play steps of the same nested-depth bonus game.

In step 130, in response to the triggering of a bonus game, a new corresponding bonus game is formally initiated. In one embodiment, the BGL value is incremented to specify the nested-depth level of the current bonus game. Thus, the value of the BGL specifies and indicates the depth of the bonus game play steps being performed or tallied.

In step 140, a play step of the bonus game is initiated at the specified BGL. A counter may be used to track play steps at the current BGL value. In one embodiment, a spin of a number of symbol-bearing reels is performed to generate a symbol outcome (i.e., a combination of symbols) based on one or more random numbers. The number of specified play step events for that BGL value is decremented when completed. In one embodiment, a bonus game is triggered (having an assigned BGL value), and a number of spins of symbol-bearing reels is granted. The number of reel spins is decremented in response to determining a symbol outcome for each spin. In another embodiment, the number of play steps for a bonus level may correspond to a number of player selections made from a pick field of indicia; the total number of indicia to be chosen by the player is decremented in response to each player indicia choice.

In step 150, a determination is made as to whether an additional (new, nested) bonus game is triggered by the outcome of the conducted play step. If so, the process flow returns to step 130 where the BGL value is incremented and a new (child) nested-depth bonus game begins. This exhibits the hierarchical arrangement of multiple bonus games and how nested bonus games are combined to create a multi-level bonus game of the casino wagering game.

In step 160, a determination is made as to whether any play steps remain for the BGL. That is, a decision is made to continue or terminate the current nested-depth bonus game dependent upon the number of play steps remaining for the BGL value. If the bonus game is determined to continue, for example, due to remaining (unresolved) play steps, the process flow returns to step 140 where the next play step for the BGL value is performed. Otherwise, this indicates that all the play steps of the BGL have been performed and resolved, and the bonus game having the current BGL value concludes.

In step 170, the BGL value is decremented to designate the conclusion of the nested-depth bonus game when all play steps are resolved.

In step 180, a determination is made whether the BGL is equal to the base game level as assigned in step 125. This determination is made to decide whether any nested-depth bonus games are still in progress. The current value of the BGL indicates a nested depth of the parent of the just concluded bonus game. In response to the BGL value indicating an additional unresolved bonus game remains in progress, the process flow returns to step 140 where the next play step of the current BGL is performed. The process of conducting play steps for each BGL, determining outcome results for the play steps, triggering and resolving new "child" bonus-game levels, and resolving results for the nested-depth bonus games continue until there are no more bonus games to process, and flow returns to the base game (i.e., the base game level).

In step 190, in the event that no bonus game was triggered in the base game, or the play steps of all the nested-depth bonus games are performed and completed, a determination is made as to whether any play steps remain for base game. That is, a decision is made to continue or terminate the base game dependent upon the number of remaining base-game play steps. Typically, a (wagering) base game will have only a single play step, but it is possible to have multiple play steps assigned to the base game for a single wager. For example, a gaming machine offering two play steps (e.g., reel spins) at the same wager amount for a single placed wager. If additional play steps remain to be resolved, the process flow returns to step 110 where the next base-game play step is conducted.

In step 199, the game cycle concludes when there are no more remaining play steps to be resolved in the base game and all bonus games has been resolved. Thus, the game cycle includes all of the play steps (e.g., free spins, field picks, etc.) for the base game and each bonus game (if any). The conclusion of the game cycle is completed by performing a final transfer of all the accumulated won credits to the player's credit meter for each of the play steps, even if that amount is zero.

Thus, the process 100 of conducting distinct game cycles of a casino wagering game has been described. Many additional processes may be used in conjunction with process 100 that control or specify the organization of bonus games (e.g., whether the bonus games are performed in parallel or hierarchically), various accompanying presentational features (e.g., animation, audio/video sequences, celebrations, etc.), etc.

Figure 5:
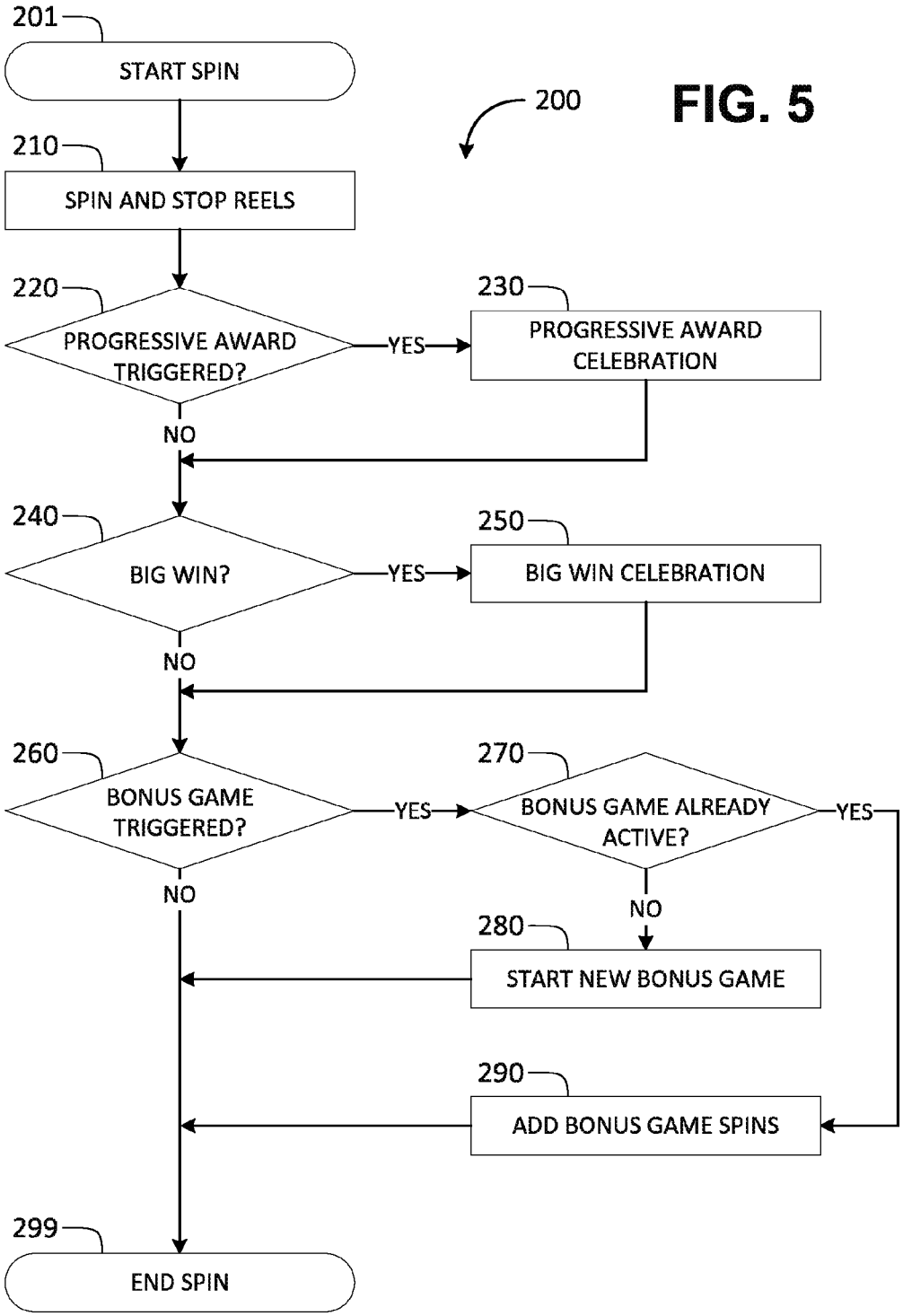
FIG. 5 is a flowchart for a process of performing a play step of a casino wagering game, according to an embodiment of the present invention.

Referring now to FIG. 5, a process 200 describing the process of performing a casino wagering game play step in one embodiment. The process 200 describes a particular type of play step in a wagering game, a spinning and stopping of symbol-bearing reels (based on one or more random numbers as discussed prior) to generate a combination of symbols in a symbol outcome for the play step. The outcome is compared to a pay table dictating winning symbol combinations, credit payouts, bonus games triggers, etc.

In step 201, a spin of the casino wagering game is initiated, for example, in step 110 or step 140 of FIG. 1.

In step 210, the symbol-bearing reels begin to spin and stop to reveal a symbol outcome for the casino wagering game. The position where a reel stops may be determined by one or more random numbers dictating a particular stopping position of the rotating reel, revealing one or more symbols that become part (or all) of the symbol outcome. The spin may be a base-game level spin or a bonus-game level spin as described prior.

In step 220, a determination is made as to whether a progressive award is triggered by the symbol outcome. In step 230, a progressive award celebration is conducted by the wagering gaming machine (e.g., machine 10) to alert the player to the triggering of the progressive award and promote player excitement.

In step 240, after any progressive award processing is completed, a determination is made related to the symbol outcome and an amount of credits being awarded in response to the symbol outcome. In one embodiment, a threshold is specified that corresponds to the wager amount placed at the beginning of the game cycle. For example, if a wager amount for the game cycle is made at one-hundred credits, a "big-win" threshold may be set at ten times the bet, or one thousand credits. If this threshold is met or exceeded, the symbol outcome is deemed a "big win", and a corresponding celebration will occur in response to the symbol outcome (step 250). If the credit award for the outcome does not exceed the set threshold, no "big-win" occurs, and processing continues in step 260.

In step 260, a determination is made as to whether a bonus game is triggered by the symbol outcome. In one embodiment, this decision correlates to step 120 and step 150 of FIG. 1.

In step 270, when it is determined that a bonus game (or nested bonus game) is triggered by the symbol outcome of the spin, another determination is made to determine whether the triggered bonus game (or nested bonus game) is a bonus game that is already active.

In this embodiment, this determination provides protection against situations where repeatedly triggered nested bonus games may result in excess memory allocation (possibly causing errors or faults during execution of digital storage). When a bonus game is triggered as a result of a symbol outcome, a specific number of play steps of the bonus game are awarded and initiated. If additional play steps are granted for a particular bonus game during one or more bonus games, the number of the additionally awarded play steps may be added to the current number of play steps for that bonus game (e.g., having a particular BGL value). Thus, if a game cycle includes seven different bonus games that may be triggered by a symbol outcome of the base game or any bonus game, a maximum total of seven BGL values (as described in FIG. 1) are required for the nested depth bonus games, rather than a distinct BGL for each repeated triggered bonus game. Thus, as additional bonus games are triggered, the system increments the play steps for an allocated BGL (specific to each bonus game) rather than creating ever increasing BGL values for bonus game already initiated.

In step 280, in response to the triggered bonus game not being active (i.e., no prior BGL value has been defined for the triggered bonus game during this game cycle), a new bonus game (i.e., having a new BGL value) is initiated having a number of associated play steps corresponding to the symbol outcome (e.g., five free spins for the newly defined third bonus game having BGL=4).

In step 290, in response to the triggered bonus game already being active (i.e., a BGL value is already defined), the number of play steps corresponding to the symbol outcome are added to the play step count for the established, corresponding bonus game (i.e., add five free spins to the defined bonus game having BGL=4).

Thus, the first time a particular bonus game is triggered, a number of play steps (events, e.g., spins, picks, etc.) are attributed to that nested-depth bonus game having an incremented BGL value determined solely for that bonus game. When a repeat bonus game is triggered (corresponding to triggering a bonus game already having a BGL), a number of play steps are added to the play steps for the BGL.

Thus, while using a BGL value for the base game (e.g., BGL=1), the number of additional BGL values stored as part of the game cycle data is exactly equal to the number of distinct bonus games that are currently active. Each BGL value (even for the base game) has an associated play step count indicating the number of play steps (e.g., events, instances, free spins, wheel spins, field picks, etc.) conducted for that nested-depth bonus game during the game cycle.

In step 299, the play step operation terminates with operations required to fully conclude a spin operation, for example, accruing an award value indicating a total number of credits won during the spin. Other operations may include incrementing a tally of completed spins for a given time period, compensating a player with corresponding loyalty points, conducting additional operations performed during every spin, etc.

Figure 6A:
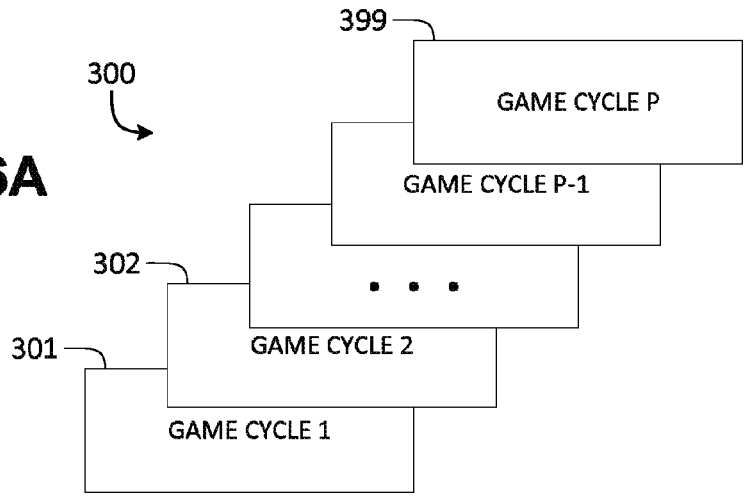
FIG. 6A is a schematic representation of a memory segment of the game-logic circuitry of a wagering game machine containing game cycle data records, according to an embodiment of the present invention.

Referring now to FIG. 6A, a schematic representation of a section of non-volatile memory 300 of a wagering game machine is shown in one embodiment. The memory 300 contains a set of game cycle data records 301-399 containing game cycle data for the most recent game cycles conducted by the wagering game machine. A total of P game cycle data records is maintained within the memory 300. The number of game cycle data records (P) is predetermined and may change due to changes in jurisdictional regulations, record sizes, and/or memory constraints.

In one embodiment, the game cycle data includes play step data for displaying or regenerating outcomes for the base game and a predetermined number of the most recent play steps of the game cycle. For example, in a game cycle where a number of play steps performed does not exceed the predetermined number of stored play steps, data for all the play steps is recorded and maintained as part of the game cycle. In short, a predetermined number of the most recent play steps of each game cycle are maintained in the game cycle data stored in non-volatile memory, accessible even after power loss or a fault in the gaming machine.

Additionally, the game cycle data may include summary screen data maintaining accrued results of displayed play step outcomes for play steps not among the most recent play steps of the game cycle. Thus, when a number of performed play steps exceeds the predetermined number of recently stored play steps, the oldest (most non-recent) play step data is accrued into summary data prior the play step data being purged from memory. The play step data is accrued into a tabulation specific to the nested bonus-game level (i.e., BGL) of the oldest play step data being purged.

Further, the game cycle data for each game cycle contains data specifically related to all bonus game triggering play steps that occur. Thus, the play step data for each play step that triggers a bonus game is always maintained in the game cycle data. In this way, the game cycle data records are efficiently maintained having all contextual play step data relating to all bonus game triggering events.

Figure 6B:
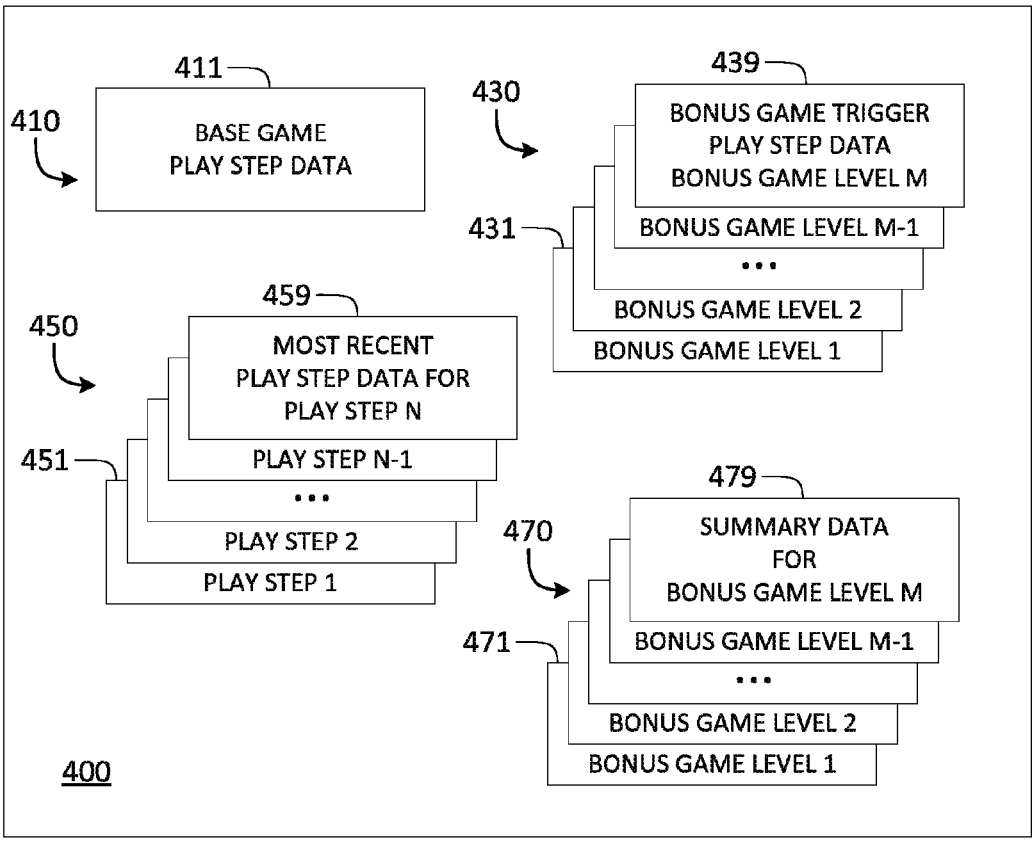
FIG. 6B is a schematic representation of a game cycle data record of a wagering game, according to an embodiment of the present invention.

Referring now to FIG. 6B, a schematic representation of a single game cycle data record 400 is shown in one embodiment. The game cycle data record 400 contains game cycle data including base-game play step data 410, bonus-game-trigger play step data 430, most recent play step data 450, and summary data 470. As a component of the game cycle data is created and prepared for storage (in accordance with the defined methodology and any governing regulations), the component data is stored within the game cycle data record 400. Prior to component generation, the various sub-records of the game cycle data record 400 may be empty (or "null"), taking up little or no memory until populated with actual data.

The base-game play step data 410 is shown with only a single stored base-game play step data record 411, but multiple records may exist when multiple base game play steps are performed during a single game cycle. Each base-game play step data record 411 contains information allowing the outcome of the base-game play step to be redisplayed, and perhaps, refabricated. For example, if the base-game play step data record 411 contains a set of random numbers used to generate the outcome using a particular algorithm, the entire base-game play step may be recreated and shown to the player in the same fashion it was previously displayed.

The bonus-game-trigger play step data 430 contains a set of bonus-game-trigger play step data records 431-439. There are a total of M records, where M is equal to the number of bonus game triggers in the game cycle. Resultantly, a total of M bonus games are performed during the game cycle 400.

The most recent play step data 450 contains a set of play step data records 451-459 that comprise the most recent, non-bonus-game-triggering play steps of the game cycle 400. Any play steps that trigger a bonus game are stored as part of the bonus-game-trigger play step data 430. A total of N play step data records 451-459 are maintained, where N is a predetermined number generally selected in response to be compatible with the governing jurisdictional regulations. For example, if a set of regulations for a wagering game machine requires the last twenty play steps of each game cycle to be maintained, N is chosen to be twenty.

The summary data 470 contains a set of summary data records 471-479. A summary data record 471-479 is created for each bonus game (as a result of each of the M bonus game triggers), although these records may remain empty (or "null") until needed. Thus, a total of M summary data records, one for each bonus game conducted during the game cycle 400. Additionally, an information record for the base game may also be allocated and maintained (not shown) that may include information particular to the base-game play step data 411, all play steps of the entire game cycle 400, or any combination of play step data. For example, a summary data record may be kept for all play steps occurring as a result a single parent play step, regardless of whether the particular play step data is explicitly stored in the game cycle data 400. Thus, the game cycle data may also maintain a single summary data record (not shown) relating to the accrued totals of all the play step data occurring during the game cycle that the game cycle data 400 relates.

Other information may also be included in the game cycle data 400 that may be determined during the game cycle, although these extraneous items are not explicitly shown. For example, play step timestamp or duration data, player button selection information, sensed information, etc., may be gathered and stored in the game cycle data 400.

The game cycle data 400 stored for each of the recorded game cycles may facilitate reproduced display of the outcome(s) of play steps of a game cycle by an administrator, a player, or anyone having the proper authorization to do so for verification or observance. For example, an administrator may examine the displayed outcome of a wagering game to verify the triggering of a large cash award (e.g., hand-pay), or the triggering of a progressive jackpot. A player or observer may want to post the wagering game outcome to one or more social networks so that friends and family are able to witness the outcome as it was originally presented.

The use of stored state data (e.g., storage of various animation sequences in process and/or applied graphical and/or color themes in use at the time of the outcome), and/or captured audio/video of the player and/or game machine may be stored as part of the game cycle data to more accurately duplicate the displayed outcome at the time of original presentation.

Combined with summary screens having formatted textual output, a complete overview of the game cycle from the initial base-game play step may be achieved that includes static image representations (reporting the actual displayed outcomes) in addition to textual, numerical, and/or graphical representations (reporting results of the outcomes) of the game cycle. That is, the play step data contained within a play step record may include graphical data, alpha-numerical data, or a combination of these. The various play step data records may be used to directly display a displayed outcome (e.g., screenshot) or be used to replicate, duplicate, or otherwise regenerate the play step as originally displayed. For example, the stored play step data may be used to display the outcome screen as viewed by the player at the time of initial display, or be used to recreate the outcome display exactly as initially presented to the player during the wagering game.

For example, the game cycle data contains play step data and summary data that may provide an entire view of the game cycle, complete with triggering events and information that contextualize subsequent events. The play step data (including base-game and bonus-game bonus-game-triggering play steps, and the predetermined number of the most recently performed play steps) may include replay data that enables the wagering game machine (or a remote display terminal) to replay one or all of the important play steps of the game cycle, partially or entirely, in order of display or in any order. Further, the summary data may be formatted in any way to report important information related to the wagering game cycle as a whole, sub-portions of the wagering game (e.g., one or more bonus games, potentially nested), sets or collections of play steps of the game cycle, and/or particular play steps of the game cycle.

The game cycle data may be used to chronologically present the outcome of play step events of the game cycle, particularly the most recent play steps of a particular bonus game or the most recent play steps of the game cycle spanning multiple bonus games. For example, a game cycle may include a first and a second nested-level bonus game, where a play step in the base game triggers the first bonus game, and a play step in the first bonus game triggers the second nested-level bonus game. The play step data of the game cycle may be used to replay any or all of the triggering steps of the game cycle. Further, other triggering events, including progressive jackpots or other "BIG WIN" play step outcomes may be selected to be routinely stored the game cycle data for all play steps, and may be selectively used to regenerate, replay, or reflect the outcome results for the event(s) using corresponding the play step data.

Additional presentation formats may include one or more summary screen(s) presented such that chronology of the play steps in the base game and bonus games is kept intact. The summary screens may also be implemented to display results spanning one or more play steps, one or more bonus games, and even one or more game cycles.

Figure 7A:
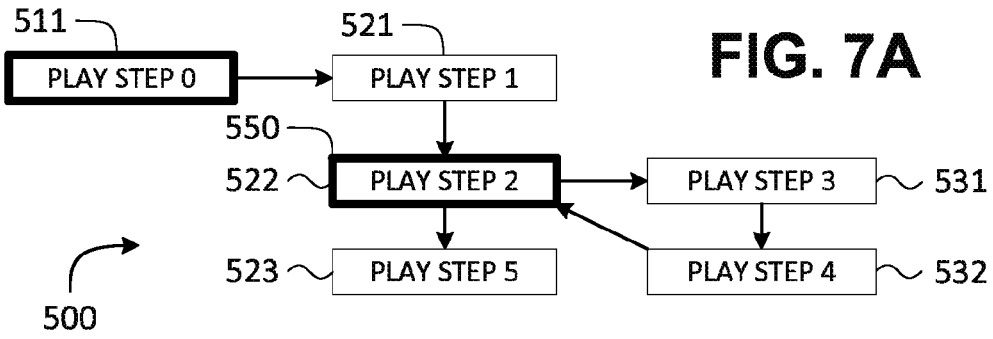
FIG. 7A is a schematic representation of a set of play steps conducted during a multi-level bonus game of a game cycle, according to an embodiment of the present invention.
Figure 7B:
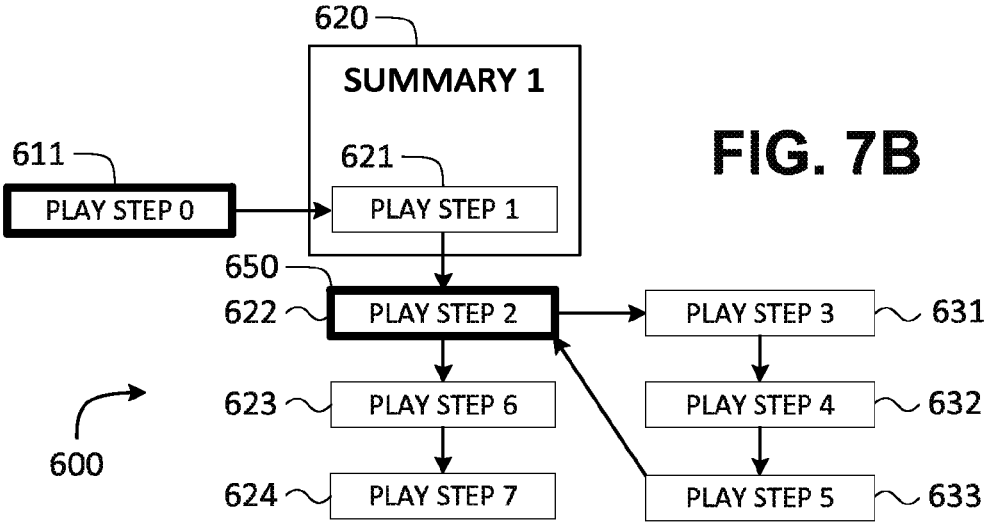
FIG. 7B is a schematic representation of a set of the play steps conducted during a multi-level bonus game of a game cycle, according to an embodiment of the present invention.
Figure 7C:
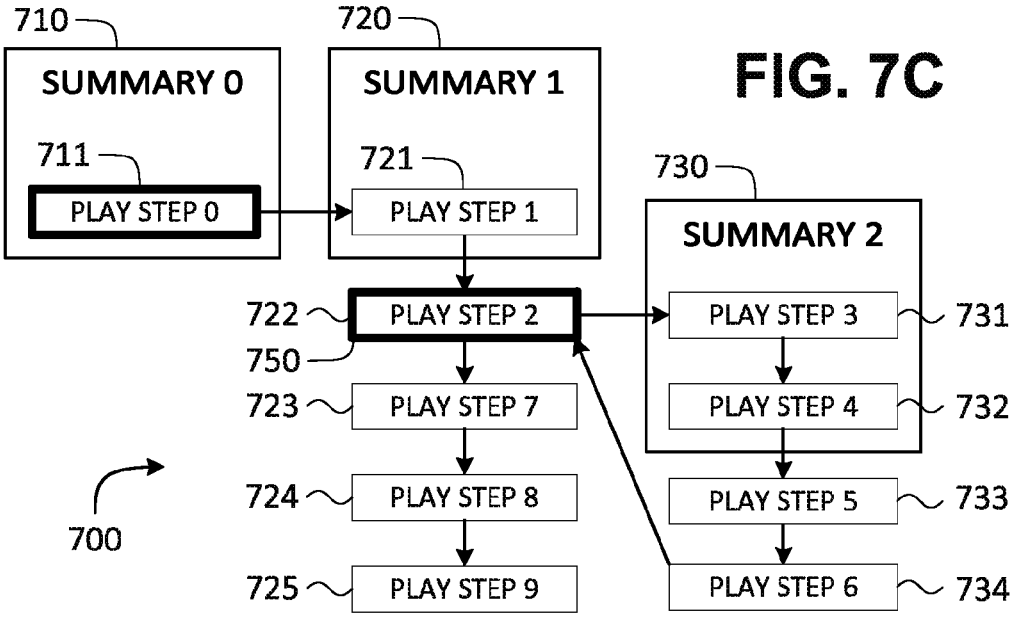
FIG. 7C is a schematic representation of a set of the play steps conducted during a multi-level bonus game of a game cycle, according to an embodiment of the present invention.

Referring to FIG. 7A-7C, diagrams representing various game cycles 500, 600, and 700 are displayed in distinct embodiments. The game cycles begin with a base-game play step (511, 611, and 711) that triggers a bonus game. All bonus-game-triggering play steps are highlighted in the diagram having a bold border designating that the associated play step outcome includes a bonus-game-triggering event. The outcome of base-game play step may also include actual awards (e.g., credits). In another embodiment, the outcome of the base-game play step may involve multiple bonus-game-triggering events (i.e., an outcome triggering more than one bonus game). Each column of play steps represented in the figures relates to a set of game processes corresponding to a specific bonus-game level (BGL) value. The BGL represents a value of the nested depth of the (bonus) game processes. In one embodiment, the base game is given an initial base-game level (BGL=1), and as further bonus game triggers are determined as part of the play step outcomes (if any), the BGL value is incremented as a new bonus game is initiated (having BGL=2). Each BGL includes all the play steps of the corresponding bonus game, the bonus game continuing until all the play steps for the BGL value are depleted and resolved. Once all the play steps for a BGL value are depleted, the BGL value is decremented, and the remaining play steps of the prior BGL value continue to be resolved until all remaining play steps for the BGL are depleted (or an additional bonus game is initiated). This process continues until all play steps are depleted for each BGL value and the game cycle concludes.

In one embodiment, the game cycles shown in FIGS. 7A-7C are presumed to be operating in the same governing jurisdiction having specific regulations requiring wagering game machines to digitally store a specific number of game cycle data records in non-volatile memory. In these examples, a jurisdictional regulation requires that stored game cycle data must include the base game play step (511, 611, and 711) and the five most recent play steps of the game cycle. Further, the ten most-recent game cycles must be maintained. To comply with these regulations, a gaming machine must securely store and maintain game cycle data for each of the most recent ten game cycles in non-volatile memory.

In one embodiment, the game cycle data for a game cycle (e.g., 500, 600, 700) includes the base game play step (e.g., 511, 611, 711), all the bonus game triggers (e.g., 550, 650, 750), and the play step data for at least five of the most recent play steps of the game cycle (unless fewer play steps are performed). Resultantly, as long as five or less play steps are performed in addition to the base game play step during the game cycle, all the play steps of the game cycle will be digitally stored in the game cycle data. However, if more than five play steps are conducted, any additional play steps (that are not bonus game triggers) will be dropped from memory and not stored in the game cycle data. Instead, summary data will be generated for play steps occurring during the game cycle that are not expressly stored.

Referring now to FIG. 7A, a schematic diagram for indicating the play steps for a game cycle 500 having nested bonus games is displayed in one embodiment. The game cycle 500 includes a base-game play step 511 that includes a bonus-game trigger. Thus, as a result of the outcome of the play step 511, a bonus game is initiated having a specified number of play steps associated with a corresponding BGL value. In one embodiment, a number of free spins are granted in a specific bonus game selected from a set of bonus games. The base game has a BGL value corresponding to a dedicated base-game level value (BGL=1). The bonus game initiated as a result of the trigger of the base-game play step 511 uses an incremented new BGL value (BGL=2). The new bonus game is initiated having a specified number of play steps as a result of the outcome of the play step 511 (in this case, three play steps, play steps 521, 522, and 523). For example, the base-game triggering event in the base game (BGL=1) grants three free spins in a first bonus game (assigned BGL=2).

The play steps associated with the new BGL value begin with the play step 521 and the associated play step data is stored in non-volatile memory as part of the game cycle data. After the outcome for the play step 521 is determined and displayed to the player, the next play step, play step 522, is conducted in the same manner. The outcome for the play step 522, indicated by the bold border highlighting, includes an additional bonus game trigger 550, triggering a second bonus game. As a result, after the outcome of play step 522 is displayed to the player, the second bonus game is initiated having a new, incremented BGL value (BGL=3), having two free spins.

The new bonus game having the new BGL value (BGL=3) begins with the play step 531. An outcome for the play step 531 is generated and displayed to the player, and the corresponding play step data is digitally stored in the game cycle data in non-volatile memory. Following the play step 531, the play step 532 is conducted in the same manner, the gaming machine generating and displaying an outcome for the play step and storing the associated play step data digitally in the game cycle data. The play step 532 is the final play step in the BGL, so once completed, the BGL value is decremented (BGL=2), and flow returns to the completion of the play step 522 that triggered the completed bonus game. One play step remains in the first bonus game (BGL=2).

Continuing to process play steps in the first bonus game (having BGL=2), the play step 523 is conducted next and a corresponding outcome is determined and displayed. The play step 523 is the final play step of this nested-depth bonus game. Thus, the bonus game ends and the BGL value is decremented again (BGL=1). The game cycle 500 also ends, since there are no further play steps of the base game (having BGL=1) to perform and resolve. In the event that remaining play steps awaiting completion are part of the base game (e.g., a play step 512, not shown), the game cycle 500 would continue performing these base-game play steps until all remaining play steps of the base game of the game cycle are resolved (including any additionally triggered bonus games).

In this embodiment, it is noted that the governing regulations require that generated game cycle data must include the base game play step 511, all bonus game triggers 550, and play step data for at least five of the most recent play steps of the game cycle (unless fewer play steps are performed). Thus, all the play step data of the game cycle 500 is maintained in the game cycle data stored in non-volatile memory. No play step data is required to be dropped or summarized as a result of a number of play step exceeding the predetermined number of stored play steps.

Referring now to FIG. 7B, a diagram for indicating play steps for nested bonus games in a game cycle 600 is displayed in one embodiment. The game cycle 600 includes a base game play step 611 that includes a bonus-game trigger. Thus, as a result of the outcome of the play step 611, a bonus game is initiated having a specified number of play steps associated with a corresponding BGL value. The base game has a BGL value corresponding to a dedicated base-game level value (BGL=1) and the bonus game initiated as a result of the trigger in the base game play step 611 has an incremented new BGL value (BGL=2). The new bonus game is initiated having a specified number of play steps (in this case, four play steps, 621, 622, 623, and 624).

The play steps associated with the new BGL value (BGL=2) begin with the play step 621 and the associated play step data is stored in non-volatile memory as part of the game cycle data for game cycle 640. After the outcome for the play step 621 is determined and displayed to the player, the next play step, play step 622, is conducted in the same manner. The outcome for the play step 622, indicated by the bold border highlighting, includes an additional bonus game trigger 650. As a result, after the play step 622 outcome is displayed to the player, another (nested) bonus game is initiated having a new, incremented BGL value (BGL=3). The number of play steps associated with the new BGL value is three (e.g., three spins of symbol bearing reels of the bonus game having BGL=3).

The new bonus game begins with the play step 631. An outcome for the play steps 631, 632, and 633 are sequentially generated and displayed to the player, and the corresponding play step data is digitally stored in the game cycle data in non-volatile memory. The play step 633 is the final play step in the bonus game, so once completed, the BGL value is decremented (BGL=2), and flow returns to the completion of the play step 622 that triggered the latest completed bonus game.

Continuing to process play steps in the current bonus game (BGL=2), the play step 623 is conducted next, an outcome is determined and displayed, and play step data is stored. Next, the play step 624 is conducted, an associated outcome is determined and displayed, and play step data is stored.

Upon the completion of play step 624, the game cycle data for game cycle 640 contains the base game play step 611, all bonus game triggers 650 (play step 622), and play step data for exactly five of the most recent (not bonus-game triggering) play steps of the game cycle (play steps 621, 631, 632, 633, and 623). In order for the game cycle data to make room for the play step data of play step 624, the oldest (most non-recent) non-bonus-game-triggering play step data must be purged from the game cycle data. If the oldest play step data corresponds to a bonus game triggering play step, this information is not removed from the game cycle data. All bonus-game-triggering play step data is maintained in the game cycle data.

In response to the removal of the oldest non-bonus-game-triggering play step data, summary data for the BGL value that corresponds to the removed play step is tabulated into the game cycle data. The summary data is specific to the bonus game and BGL value. In this case, summary data is generated that accrues the play step data of play step 621, the oldest non-recent, non-triggering play step in the game cycle, into a running total for the bonus game.

In one embodiment, all the play step data of the removed play step(s) of the bonus game are accrued into a single summary data record. That is, as play step data is removed from the game cycle data, the play step data is merged into summary data for the bonus game of the removed play step.

In the current case, summary data 620 is generated using a portion of the play step data of play step 621. For example, the summary data 620 may include the number of credits won during the play step 621, money won during the play step 621, progressive money won during the play spin 621, and the number of bonus spins awarded during the play spin 621. Any play steps removed from the game cycle data in the future will accrue similar data into these values as the play spin data is merged into the summary data 620.

The play step data of play step 621 is then removed from the game cycle data and replaced with the play step data for the play step 624. The play step 624 is the final play step of this bonus game. Thus, the bonus game ends and the BGL value is decremented again (BGL=1). No further play steps of the base game remain to resolve, and the game cycle 600 concludes.

Referring now to FIG. 7C, a diagram for indicating play steps for a game cycle 700 having nested bonus games is displayed in one embodiment. The game cycle 700 is similar to game cycle 500 and 600 in many ways. The game cycle 700 is different due to the increasing number of occurring play steps. In the game cycle 700, the base-game bonus-game trigger (play step 711) awards five play steps (721-725) in the bonus game having BGL=2, and the nested bonus-game trigger 750 (play step 722) award four play steps (731-734) in the bonus game having BGL=3.

The play steps are sequentially numbered in the diagram to discern a sequence of the play steps, namely 711, 721, 722, 731, 732, 733, 734, 723, 724, and 725, conducted in that order. Under the constraints of the governing regulations, the base-game play step data for play step 711 is stored as part of the game cycle data, along with all bonus game triggering play step data (play step 722), and the play step data of the five most recent conducted play steps 725, 724, 723, 734, and 733.

The play step data records of the play steps that are not stored in the game cycle data for game cycle 700 are the oldest, non-triggering play steps, namely 721, 731, and 732. Portions of the play step data not specifically stored as part of the game cycle 700 are accrued into the summary data specific to the nested depth level of the bonus game (BGL value) that the play steps are associated. That is, the play step data of the play step 721 is tabulated into summary data 720 (relating to all play steps of the bonus game having BGL=2) and play step data of the play steps 731 and 732 are tabulated into summary data 730 (relating to all play steps of the bonus game having BGL=3).

In one embodiment, additional summary data 710 may be optionally created for the base-game play step 711. The play step data of the base-game play step 711 is still stored as part of the game cycle data, but one or more summary screens may be displayed containing some or all of the summary data 710 containing summarized data related to the base game. In other embodiments, a summary data record may be maintained for particular play steps, bonus-game-triggering play steps, or entire game cycles. For example, the summary data 710 may include the accrued totals for all the play steps conducted during the game cycle 700.

Figure 8A:
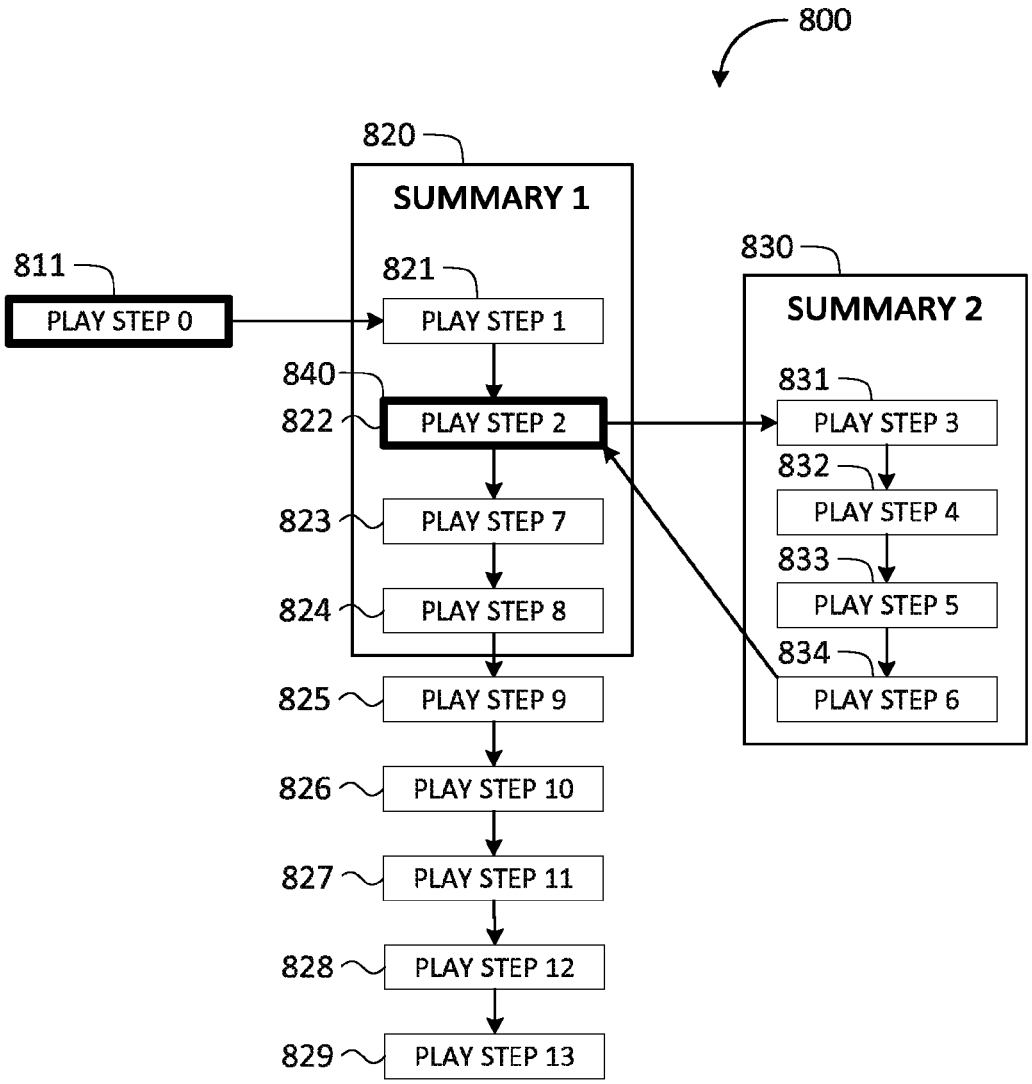
FIG. 8A is a schematic representation of a set of the play steps conducted during a multi-level bonus game of a game cycle, according to an embodiment of the present invention.

Referring now to FIG. 8A, a diagram for indicating play steps for nested bonus games in a game cycle 800 is displayed in one embodiment. In the game cycle 800, a base-game bonus-game trigger (play step 811) awards nine play steps 821-929 in a bonus game having BGL=2, and the nested bonus-game trigger 840 (play step 822) awards four play steps 431-434 in a bonus game having BGL=3.

The performed fourteen play steps (base-game play step and thirteen additional bonus-game play steps) are sequentially numbered in the diagram to discern sequencing of the play steps, namely 811, 821, 822, 831, 832, 833, 834, 823, 824, 825, 826, 827, 828, and 829, conducted in that order. Keeping with the prior regulations and constraints, the base-game play step 811 is stored as part of the game cycle data, along with all bonus-game-triggering play step data (play step 822), and the play step data of the five most recent conducted play steps 825, 826, 827, 828, and 829.

The play step data of the play steps that are not expressly stored in the game cycle data for game cycle 800 are the oldest, non-triggering play steps, namely 821, 831, 832, 833, 834, 823, and 824. The play step data for the oldest, non-triggering play steps not expressly stored are accrued into the appropriate summary data specific to the nested depth level of the bonus game of the associated play steps. That is, the play step data of the play step 821, 823, and 824 are accrued into summary data 820 (relating to all play steps of the bonus game having BGL=2) and the play step data of the play steps 831, 832, 833, and 834 are accrued into summary data 830 (relating to all play steps of the bonus game having BGL=3).

It is noted that all play step data for the bonus game having BGL=3 are part of the summary data 830. Thus, a summary screen generated and displayed using the summary data 830 will show a summary of the results of the entirety of the bonus game having BGL=3, for example, a number of spins executed, a number of additional spins granted, and a number of credits won for the entire bonus game. The summary data 830 may include a much more detailed accounting of the bonus game having BGL=3, as previously discussed. Since none of the play step data for the bonus game are expressly stored, a more detailed amount or type of summary data 830 may be warranted to help quickly resolve disputes or accounting for specific events occurring in play steps 831-384.

Figure 8B:
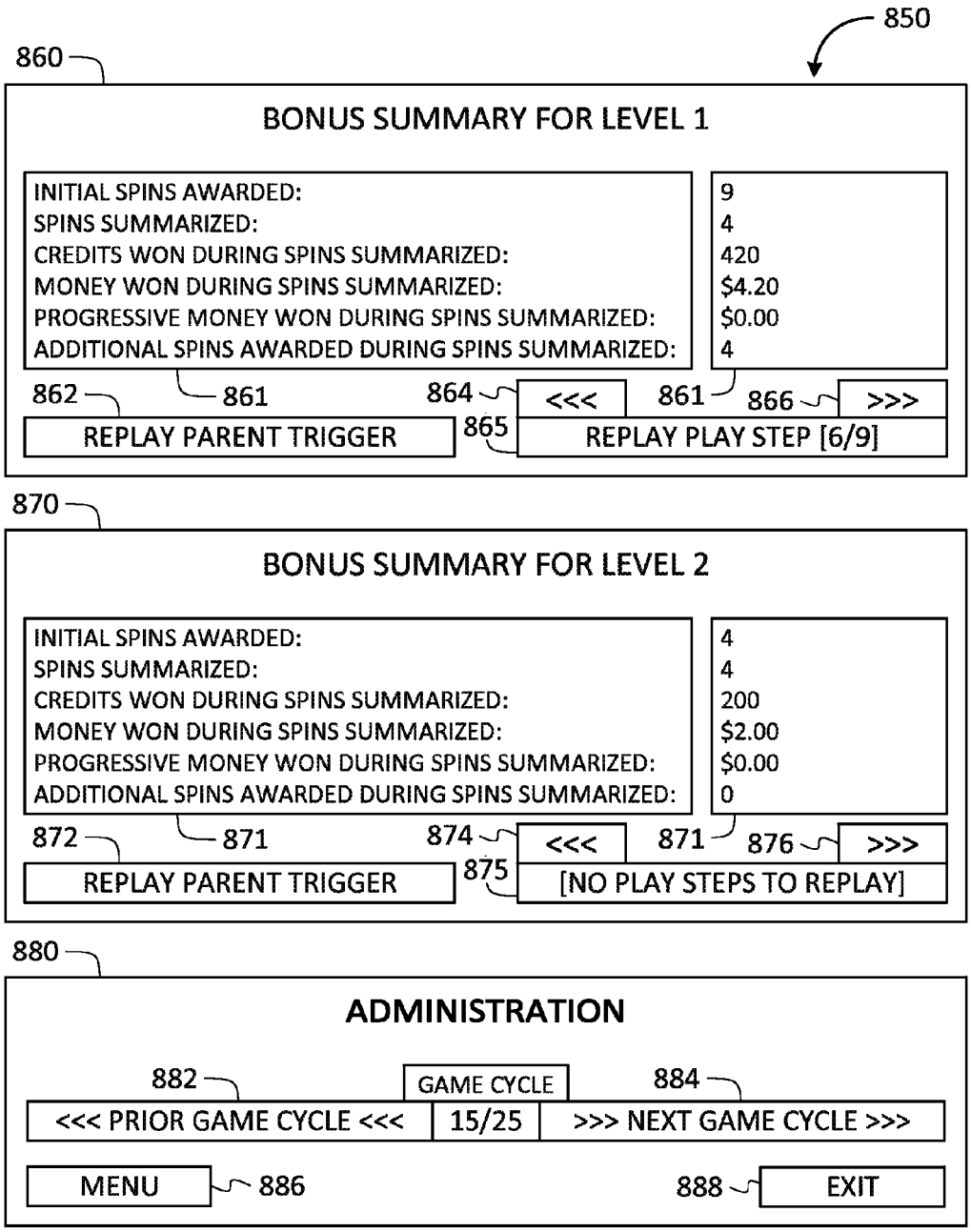
FIG. 8B is an example representative display output containing summary screens relating to the game cycle displayed in FIG. 8A, according to an embodiment of the present invention.

Referring now to FIG. 8B, a representative display output 850 for the game cycle 800 is displayed in one embodiment. The display output 850 corresponds to the game cycle data of the game cycle 800 shown in FIG. 8A. The display output 850 may be output on an electronic display device coupled to a wagering game machine that performs a casino wagering game generating wagering game cycle data, or may be remotely located.

The display output 850 includes a first-level summary display section 860, a second-level summary display section 870, and an administrative display section 880.

The display section 860 includes summary screens 861. The summary screens 861 display the summary data specific to a specific bonus game assigned to a defined nested-depth bonus level (e.g., BGL=2). That is, the summary screens 861 reflect the values of the summary data 820 generated from the accrued play step data of the summarized play steps 821-824. In other embodiments, summary screens may look very different from the summary screen 860 in FIG. 8B, and reveal some or all of the summary data 820 in a variety of ways, as discussed prior.

The display section 860 includes buttons 862, 864, 865, and 866. In one embodiment, the button 862 may be used to replay the play step triggering event that triggered this particular nested-depth bonus game (the base-game play step 811). Upon selection of the button 862, the wagering game machine (or remote display device) will replay the play step 811 using the play step data associated therewith stored in the game cycle data for this particular game cycle.

In one embodiment, the outcome for the play step 811 is fully reproduced by the game-logic circuitry, for example, reproducing the play step using the selected random numbers stored in the play step data to exactly duplicate the display output observed by the player at the time of the original play step display. In another embodiment, a graphical image of the previously displayed outcome for the play step 811 is displayed. In another embodiment, numerical or representative symbols may be used to display the outcome of the play step 811. Any method of play step outcome display may be used that accurately reproduces and represents the originally displayed outcome of play step 811.

Similarly, the button 865 is used to replay the specified play step (i.e., play step 826) using the corresponding play step data of the game cycle data. The buttons 864 and 866 may be used to decrement or increment the specified play step. In one embodiment, after replay of the specified play step, an automatic incrementing of the play step displayed upon selection of the button 865 is performed. Any and all of the available play steps for this nested-depth may be displayed in this manner. However, play steps that were purged from memory are not available for display due to the absence of corresponding play step data. Instead, the outcome and results of these summarized spins are reflected in the summary screens 861.

The section 870 uses the summary data 830 (comprising summarized play step data of the play steps 831-834) to display information derived from the outcomes of play step data of another bonus game having another assigned nested-depth bonus level (e.g., BGL=3). The display section 870 includes summary screens 871, buttons 872, 874, 875, and 876, and operates similarly to display section 860 in regard to a different bonus game nested-depth level (e.g., BGL=3).

The administrative display section 880 has a number of buttons 882, 884, 886, and 888, that allow an administrator to decrement the current game cycle, increment the current game cycle, enter a menu to enact other options, or exit the summary screen 850, respectively.

Figure 9A:
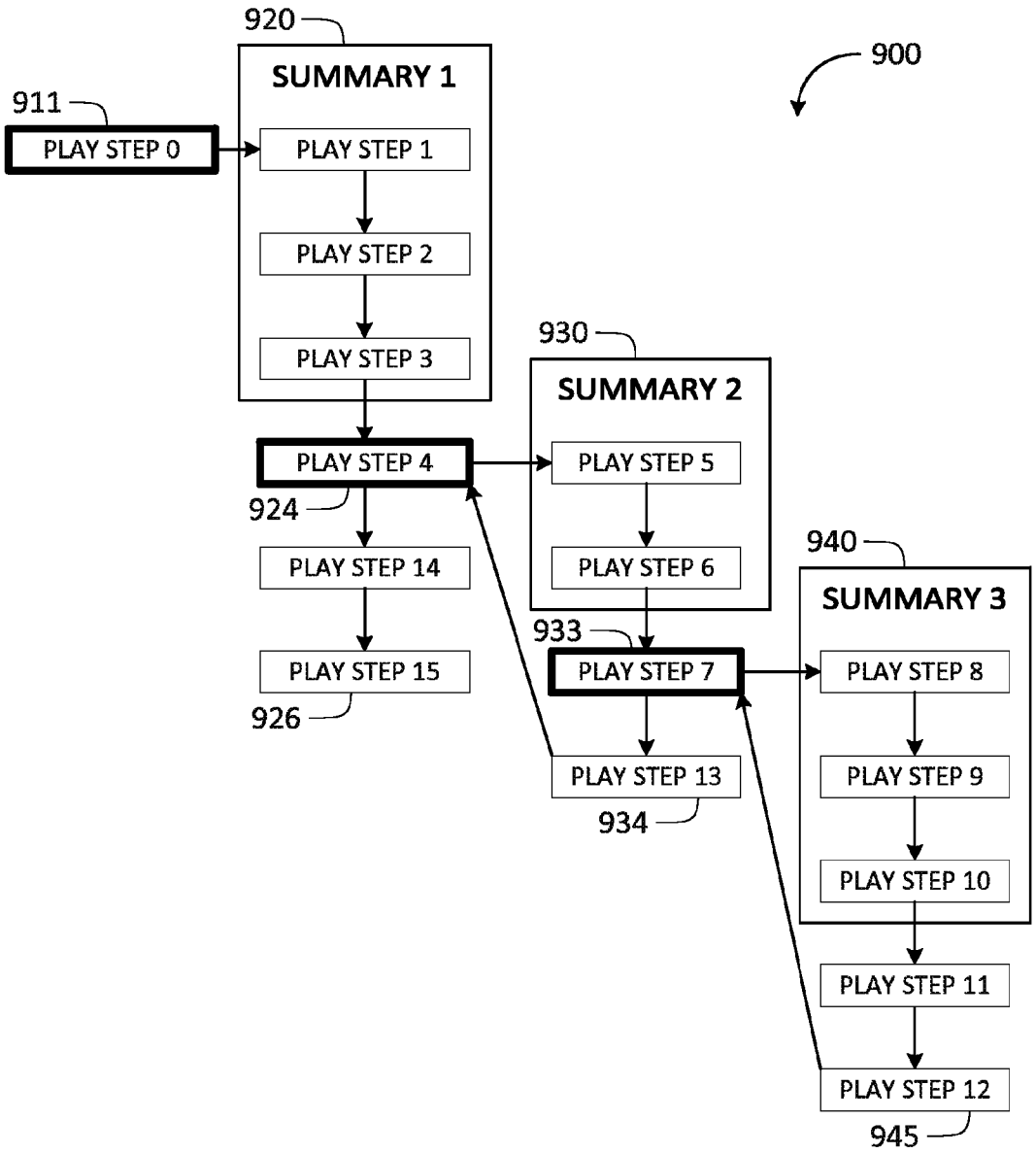
FIG. 9A is a schematic representation of a set of the play steps conducted during a multi-level bonus game of a game cycle, according to an embodiment of the present invention.

Referring now to FIG. 9A, a diagram for indicating play steps for a plurality of nested bonus games in a game cycle 900 is displayed in one embodiment. In the game cycle 900, a base-game (having BGL=1) bonus-game trigger (play step 911) awards six play steps in a bonus game having BGL=2. Of these, play step 924 triggers another bonus game (having BGL=3) awarding four play steps for the bonus game. Of these, play step 933 triggers yet another bonus game (having BGL=4) awarding five play steps for the bonus game. As the last play step of a bonus game is completed (e.g., play step 945, 934, 926), subsequent play steps, if any, begin with the next play step in the parent bonus game. That is, the BGL value is decremented and any remaining play steps of the decremented BGL value bonus game are then performed. In the event another bonus game is triggered, another nested bonus game would be instantiated as appropriate. The play step triggering a nested bonus may occur in the (first) "main" bonus game or any other one of the nested bonus games.

The summary data 920, 930, and 940 include a subset of the play step data of the corresponding play step data corresponding to the bonus games having the appropriate BGL values. The bonus-game-triggering play steps 924, 933 are maintained in the game cycle data for game cycle 900.

Figure 9B:
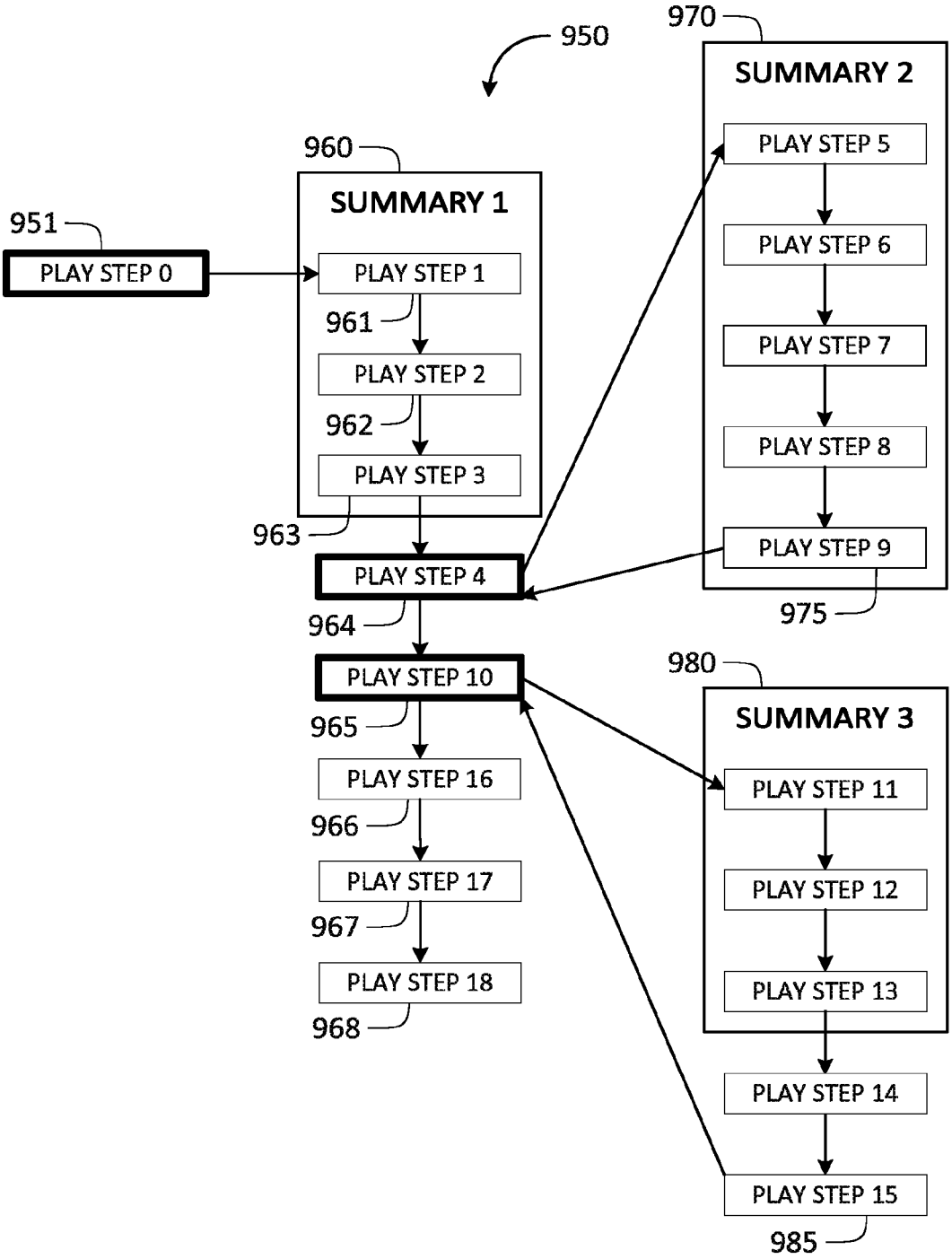
FIG. 9B is a schematic representation of a set of the play steps conducted during a multi-level bonus game of a game cycle, according to an embodiment of the present invention.

Referring now to FIG. 9B, a diagram for indicating play steps for nested bonus games in a game cycle 950 is displayed in one embodiment. In the game cycle 950, a base-game (having BGL=1) bonus-game trigger (play step 951) awards eight play steps in a first bonus game having BGL=2. Of these, play step 964 and 965 are bonus-game-triggers. The second bonus game triggered by play step 964 awards five play steps of the second bonus game having BGL=3. The play steps for this bonus game are initiated and completed prior to another bonus game being triggered. The bonus game triggered by play step 965 awards five play steps of a third bonus game having BGL=4. As the last play step of a bonus game is completed (e.g., play step 975, 985), subsequent play steps of the parent bonus game are performed until a new bonus game is triggered or the remainder of the awarded play steps for the bonus game are conducted.

Conforming to the governing regulations, the game cycle data for the game cycle 950 includes the play step data for the base-game bonus-game trigger (play step 951), all bonus game triggers (play steps 964, 965), and the five most recent non-bonus-game-triggering play steps. The game cycle data also includes summary data 960, 970, 980 for each bonus game including accrued play step data of the corresponding play steps that are not expressly stored in the game cycle data.

In one embodiment, a wagering game may have a fixed number of possible bonus games that may be triggered at any time, even while conducting play steps for one of the bonus games. As detailed prior, in the event an additional bonus game is triggered, another nested bonus game is instantiated (having a distinct BGL value) unless a prior instance of that bonus game is/was conducted in the current game cycle. As shown in FIG. 9B, even though the bonus games having BGL=2 and BGL=3 are the same nested depth, the two bonus games are given different (incremented) BGL values to discern a difference between the two bonus games.

When repeated instances of a bonus game occur, the same BGL value used previously for the prior instance of the bonus game is used to conserve the amount of memory used in storing game cycle data and limit the number of reiterative bonus game instances that are concurrently operating. For example, in the event that play steps 964 and 965 triggered the same bonus game, a common BGL value (BGL=2) may be used, and the summary data 970 would include the summary data 980 (as a single summary data record corresponding to the common BGL value).

Likewise, as additional play steps are awarded for a bonus game that has been previously defined in the game cycle, the corresponding previously-defined BGL value is used rather than generating an additional incremented value. In this way, the maximum BGL value can be capped to the sum of the base-game BGL value and the number of possible bonus games.

Figure 10:
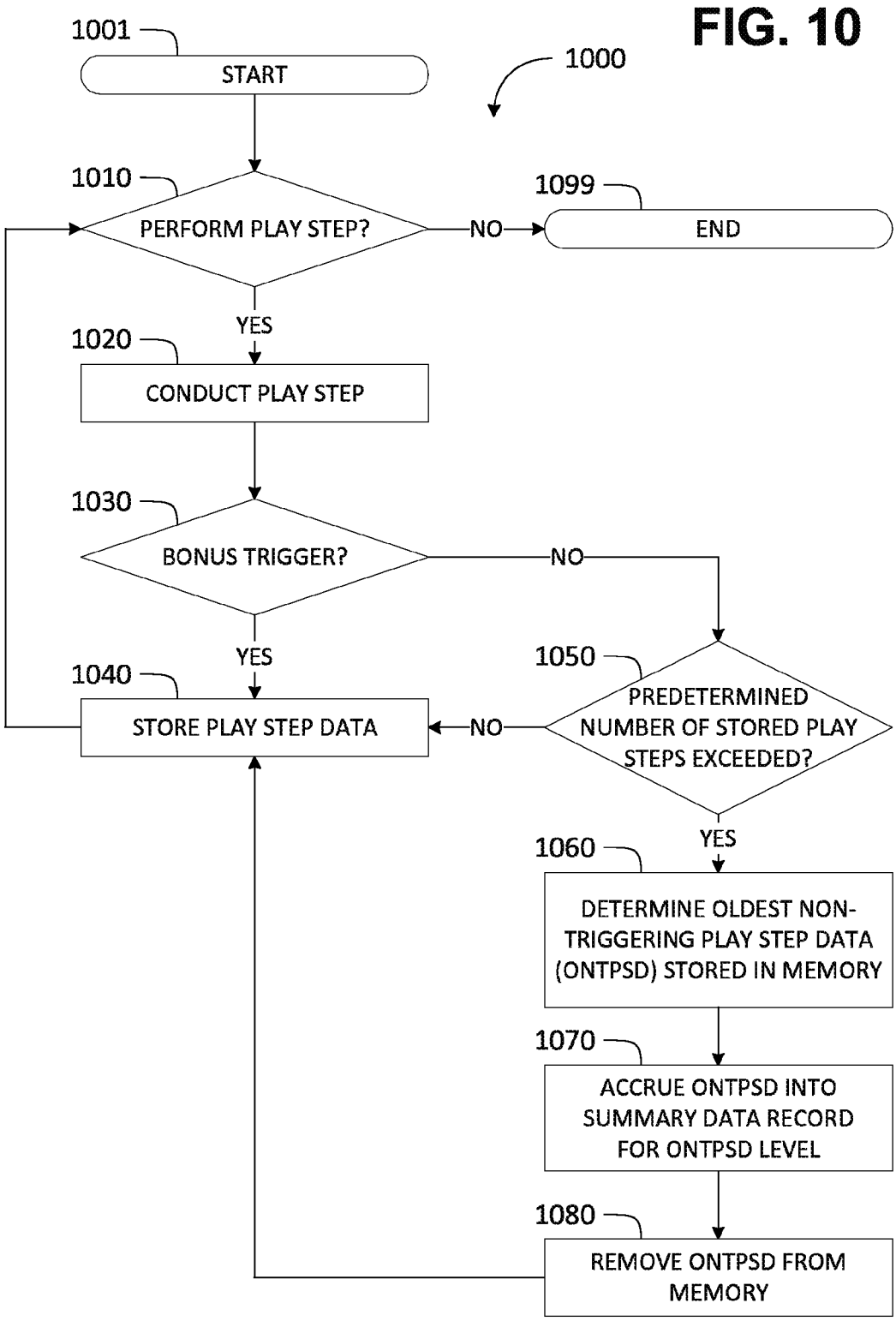
FIG. 10 is a flowchart for a process for maintaining play step data and summary data for a game cycle performed by a wagering game machine, according to an embodiment of the present invention.

Referring now to FIG. 10, a process 1000 is illustrated for maintaining play step data and summary data for a game cycle performed by a wagering game machine in accordance with one embodiment. In one embodiment, FIG. 10, described by way of example above, represents one data-processing method corresponding to at least some instructions stored and executed by the game-logic circuitry 40 in FIG. 2 to perform the above described functions associated with the disclosed concepts.

In step 1001, the process 1000 begins as a part of a game cycle, for example, in response to a call for a play step to be conducted for a casino wagering game. A maximum number of stored non-triggering play step data records in the game cycle data is predetermined to conform to jurisdictional regulation requirements of the wagering game machine. Other factors may include play step data record size, memory constraints of the wagering game machine, administrative settings, etc.

In step 1010, a determination is made as to whether a play step is to be performed. In one embodiment, the process 1000 is called to conduct a play step and perform a selective play step data storage and purging process and maintain summary data including play step data for non-stored play steps in the game cycle.

In step 1020, the play step is conducted, the play step outcome is displayed to the player, and the play step data is generated. The play step data may include one or more of graphical data (e.g., a screenshot of the outcome), data directly representing the results of the play step outcome, data capable of enabling reproduction of the results of the play step output to be regenerated, or a combination of these. The play step data is digitally stored in a play step data record, preferably in non-volatile memory.

In step 1030, a determination is made as to whether the play step conducted in step 1020 is a bonus-game-triggering event. In one embodiment, play step results that trigger a bonus game are mandated to be stored in the game cycle data. In other embodiments, conditions for this determinations may be modified to control which play step events may be used to mandate storage of the play step data. For example, progressive jackpot triggers may be isolated for guaranteed storage in the game cycle data as previously discussed. Thus, the determination of step 1030 may be modified to accommodate different conditions that may have dependence upon the size of the play step data records, the amount of non-volatile memory available for game cycle data storage, and jurisdictional regulations.

In step 1040, the play step data for the conducted play step is stored in the game cycle data. In the event that that play step data is mandated to be stored (as determined in step 1030), the play step data is immediately stored.

In step 1050, when it is determined that the play step is not a bonus-game-triggering event, a determination is made as to whether the predetermined maximum number of play step data records that have been stored is exceeded. If not, the play step data is immediately stored (step 1040).

In step 1060, when it is determined that the predetermined maximum number of play step data records is exceeded, this indicates that there is a need to remove another play step data record to make room for the current play step data (since the most recent play step data must always be maintained). Thus, the data record of the oldest non-triggering play step data (ONTPSD) stored in the game cycle data memory is determined and marked for removal. In one embodiment, the play step data records are of a fixed size and the marked ONTPSD record may be particularly specified using a single memory address or pointer (e.g., an offset to the beginning address of the game cycle memory).

In step 1070, the play step data of the ONTPSD record is accrued into a summary data record of the game cycle that corresponds to the nested-depth bonus game level (e.g., BGL value) of the ONTPSD record. In one embodiment, the details of the ONTPSD record are summed to the current values of the corresponding level of the summary data of the game cycle.

In one embodiment, each defined bonus game level has summary data associated with it (as detailed prior) that includes a number of play steps awarded for the level, a number of play steps accounted in the summary data, a number of credits won in the play steps accounted in the summary data, an amount of money won in the play steps accounted in the summary data, an amount of progressive money won during the play steps accounted in the summary data, and a number of additional spins awarded during the play steps accounted in the summary data.

In step 1080, after the summary data for the corresponding level of the game cycle is accounted with the play step data of the ONTPSD record, the ONTPSD record is removed from the game cycle data. After the ONTPSD record is purged from the game cycle data, the play step data of the most recently conducted play step is stored in the game cycle data.

This process ensures that play step data for a predetermined number of most recently conducted play steps are maintained in the game cycle data along with all bonus-game-triggering play steps and a complete set of summary data for all play step data that is not expressly stored in the game cycle data. The inclusion of the bonus-game-triggering play step data provides the enhanced feature of providing contextual play step data for nested bonus games rather than compressing the entirety of the bonus game, trigger and all, into a single summary screen.

Once the most recent play step data is stored (in step 1040), flow control returns to step 1010 to determine whether an additional play step outcome is required as a part of this portion of the game cycle. If more play steps are left to be performed, flow continues to step 1020 to conduct the next play step. Otherwise, no more play steps are left to conduct, so the process ends in step 1099.

Figure 11:
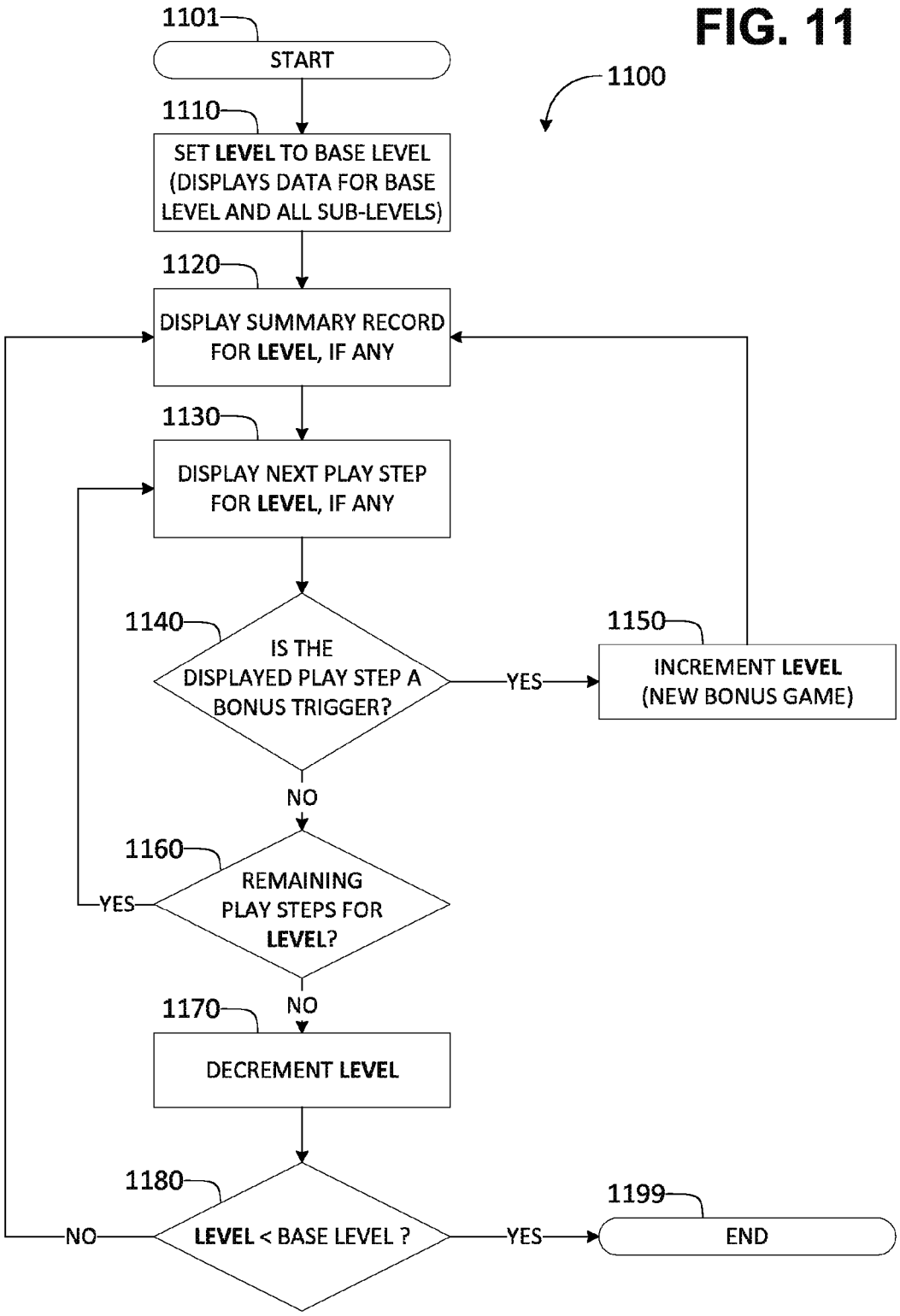
FIG. 11 is a flowchart for a process for using stored play step data and summary data to display and summarize the play step outcomes of a completed game cycle, according to an embodiment of the present invention.

Referring now to FIG. 11, a process 1100 is illustrated for displaying and summarizing the play step outcome events of a game cycle in one embodiment. The game cycle events are derived from the stored game cycle data and include a chronological display of the most recently stored play step data records and associated summary data records that make up the game cycle data. In one embodiment, FIG. 11, described by way of example above, represents one data-processing method corresponding to at least some instructions stored and executed by the game-logic circuitry 40 in FIG. 2 to perform the above described functions associated with the disclosed concepts.

The process 1100 may be performed by a wagering game machine or on a remote display device at the direction of an authorized administrator. In one embodiment, the game cycle data may enable reproduction of the previously displayed outcome of specific events (i.e., play steps) of the game cycle. The game cycle data may be used to verify the outcome of one or more play step events of the game cycle, and/or provide a way for a player of the wagering game to catalog gaming cycle experiences, for example, on a social network.

In step 1101, the process 1100 is initiated. This may be a result of a command issued after authentication of the administrator credentials and selection of a particular game cycle for examination, or as a result of a computer process made on behalf of a player for reproducing, or showing outcome results for, one or more play steps using the play step data of the game cycle data.

In step 1110, a LEVEL variable is defined having a value specifying a current index (e.g., a BGL value) for the displayed play step data outcomes and summary data of the game cycle data. That is, the value of the LEVEL variable is used to vary the display of play step data and summary data to corresponding nested-depth levels of the game cycle data.

In step 1120, one or more summary screens are used to display the summary data (comprising any condensed play step data and/or other data) corresponding to the nested-depth bonus game level of the summary data corresponding to the current LEVEL value.

Likewise, in step 1130, the next (chronological) play step data of the nested-depth bonus game level corresponding to the current LEVEL value is used to directly display, reproduce, regenerate, or otherwise report the previously displayed outcome for that play step.

In step 1140, a determination is made whether the displayed play step is a bonus-game-triggering play step.

In step 1150, if it is determined that the displayed play step is a bonus-game-triggering play step, the value of LEVEL is incremented. The new value for LEVEL indicates the initiation of a new bonus game, and more specifically, to a set of play steps corresponding to a new nested-depth level of the game cycle data. This corresponds to an increased BGL value as previously discussed.

In step 1160, if it is determined that the displayed play step is not a bonus-game-triggering play step, a determination is made whether there are remaining play step outcomes to be displayed for the nested-depth bonus game level corresponding to the current value of LEVEL. If so, flow returns to step 1130 to display the next play step outcome for the current nested-depth bonus level corresponding to the LEVEL value.

In step 1170, if it determined that no remaining play step outcomes remain to be displayed for the current nested-depth bonus level corresponding to the LEVEL value, the value of LEVEL is decremented. This indicates that the bonus game of the nested-depth bonus level has completed, and since no remaining play step outcomes are available, display of play step outcomes and summary information should continue for the parent bonus game that triggered the completing bonus level.

In step 1180, a determination is made as to whether the current value of LEVEL is less than the base-level value of LEVEL assigned during step 1110. If not, the current value of LEVEL indicates one or more remaining levels have summary data and/or play step data outcomes that have not been displayed. Thus, flow returns to step 1120 to continue processing summary data and/or play step data outcome display for the remaining levels.

In step 1199, in response to the value of LEVEL being decremented below the initial base level value assigned prior to the iterative steps of displaying summary data and play step data outcomes, the process ends. At this stage, all summary data and play steps outcomes for the specified nested-depth levels have been displayed. No further data or outcome display is necessary to report the results of the specified base level and all nested-bonus sub-levels.

For example, assigning the LEVEL variable to the BGL value of the (parent) base-game (as discussed prior, the base-game BGL=1, so LEVEL=1, step 1110), the base-game play step data (and/or summary data, if present) is used to display the base-game play step outcome and any corresponding summary screen (steps 1120-1130). In response to a base-game play step triggering a (child) bonus game (step 1140), the value of LEVEL is incremented (LEVEL=2) (step 1150). The value of LEVEL is used to display the play step data and summary data for the child bonus game (LEVEL=2, steps 1120-1130) until all the play steps of the bonus game have been displayed. In the event that one of the bonus games play steps is a bonus-game-triggering play step (triggering a new child nested-bonus game having a parent bonus game that is the child of the base game, step 1140), another incrementing of the value of LEVEL occurs to signify the new nested-depth of the new bonus game (LEVEL=3, step 1150). Now, the new incremented LEVEL value is used to display the play step data and summary data for this new bonus game level having a nested-depth corresponding to the current value of LEVEL (LEVEL=3, steps 1120-1130). Once display of all the play step data and summary data for a LEVEL value is completed, the value of LEVEL is decremented (LEVEL=2, step 1170), and if there is a parent (bonus) game (step 1180), return to display and remaining play step data and summary data of this most recent parent bonus game (steps 1120-1130). This looping operation (steps 1120-1180) occurs iteratively until all the play step data and summary data for all the values of LEVEL are completed, including the base-game, ending the process (step 1199).

The combination of express storage of play step data relating to the outcome of base game play step(s), all bonus-game-triggering play step data, and the play step data for a predetermined number of most recent chronological play steps of the wagering game cycle, in addition to summary data reflecting the outcome of all the most non-recent, non-bonus-game-triggering play steps for each nested bonus game has been described. Applying this method to each of a predetermined number of chronologically most-recent game cycles greatly enhances the efficiency of digital storage of jurisdictional regulation-mandated game cycle data in non-volatile random access memory. The resulting game cycle data provides sufficient information to fully reconstruct the play history of each of the predetermined number of game cycles. The play history for each game cycle includes the full reconstruction of the base game outcome and replay of a predetermined number of the most recent chronological play steps of the game cycle. Further, the intermediate bonus-game-triggering "parent" play step may also be reconstructed, in chronological order, for each nested bonus, providing context for any "child" nested bonus play steps. Also, summary screens including summarized play step results, per nested bonus, may be provided after replay of each intermediate "parent" play step and prior to the replay of the nested bonus play steps. This enables a fully contextualized, chronological accounting of the play steps of game cycles having large number of nested bonus game play steps.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A method of operating a gaming system, the gaming system including game-logic circuitry and a regulated gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating, by the game-logic circuitry, a base game of the casino wagering game in response to an input indicative of a wager covered by the credit balance;

in response to a base-game triggering event during the base game, conducting, by the game-logic circuitry, a multi-level bonus game of the casino wagering game, the conducted bonus game including a plurality of played levels, the plurality of played levels including a main level and a plurality of nested levels, each of the played levels including one or more play steps, at least one of the play steps in the main level being a first bonus-game triggering step that triggers one of the nested levels, at least one of the play steps in the main level or the one of the nested levels being a second bonus-game triggering step that triggers another of the nested levels;

in response to a total number of the play steps in all of the played levels exceeding a predetermined number, storing, by the game-logic circuitry in a memory device, (i) play step replay data enabling display of the outcome of the first bonus-game triggering step, the second bonus-game triggering step, and the predetermined number of the play steps, and (ii) summary data enabling display of a summary screen for each of the nested levels; and receiving, via at least one of the one or more electronic input devices, a cashout input that initiates a payout from the credit balance.

2. The method of claim 1, wherein the predetermined number of the play steps for which the replay data enables display of the outcomes consists of the last chronological play steps played in the conducted bonus game.

3. The method of claim 1, wherein the play steps include at least one of free spins of symbol-bearing reels or player selections from a pick field.

4. The method of claim 1, wherein the one or more nested levels include first and second nested levels, at least one of the play steps in the first nested level being a second bonus-game triggering step that triggers the second nested level, and wherein the replay data enables displaying, by the game-logic circuitry, the outcome of the second triggering step.

5. The method of claim 1, further including the steps of:

retrieving, by the game-logic circuitry from the memory device, (i) the replay data to reproduce and display the outcome of the bonus-game triggering step and the predetermined number of the play steps, and (ii) the summary data to display the summary screen for one or more of the nested levels; and generating, by the game-logic circuitry, and displaying, by the electronic display device, the outcome of the bonus-game triggering step and the play steps of the bonus game based upon the replay data, and the summary screen for the one or more of the played levels.

6. The method of claim 1, wherein the summary data includes the number of play steps in the respective played level, the number of play steps summarized for the respective played level, and a number of credits awarded during the summarized play steps for the respective played level.

7. The method of claim 1, wherein the replay data includes at least one of (i) graphics data related to display images of the outcome of the triggering step of each played level and the predetermined number of the play steps, or (ii) outcome data for reproducing the display images of the outcome of the triggering step and the predetermined number of the play steps.

8. A gaming system, comprising:

a regulated gaming machine primarily dedicated to playing at least one casino wagering game, the gaming machine including an electronic display device and one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

in response to a base-game triggering event during the base game, conduct a multi-level bonus game of the casino wagering game, the conducted bonus game including a plurality of played levels, the plurality of played levels including a main level and a plurality of nested levels, each of the played levels including one or more play steps, at least one of the play steps in the main level being a first bonus-game triggering step that triggers one of the nested levels, at least one of the play steps in the main level or the one of the nested levels being a second bonus-game triggering step that triggers another of the nested levels;

in response to a total number of the play steps in all of the played levels exceeding a predetermined number, store in a memory device, (i) play step replay data enabling display of the outcome of the first bonus-game triggering step, the second bonus-game triggering step, and the predetermined number of the play steps, and (ii) summary data enabling display of a summary screen for each of the nested levels; and receive, via at least one of the one or more electronic input devices, a cashout input that initiates a payout from the credit balance.

9. The gaming system of claim 8, wherein the predetermined number of the play steps for which the replay data enables display of the outcomes consists of the last chronological play steps played in the conducted bonus game.

10. The gaming system of claim 8, wherein the play steps include at least one of free spins of symbol-bearing reels or player selections from a pick field.

11. The gaming system of claim 8, wherein the one or more nested levels include first and second nested levels, at least one of the play steps in the first nested level being a second bonus-game triggering step that triggers the second nested level, and wherein the replay data enables display of the outcome of the second triggering step.

12. The gaming system of claim 8, wherein the game-logic circuitry is further configured to:

retrieve from the memory device, (i) the replay data to reproduce and display the outcome of the bonus-game triggering step and the predetermined number of the play steps, and (ii) the summary data to display the summary screen for one or more of the nested levels; and generate and display, by the electronic display device, the outcome of the bonus-game triggering step and the play steps of the bonus game based upon the replay data, and the summary screen for the one or more of the played levels.

13. The gaming system of claim 8, wherein the summary data includes the number of play steps in the respective played level, the number of play steps summarized for the respective played level, and a number of credits awarded during the summarized play steps for the respective played level.

14. The gaming system of claim 8, wherein the replay data includes at least one of (i) graphics data related to display images of the outcome of the triggering step of each played level and the predetermined number of the play steps, or (ii) outcome data for reproducing the display images of the outcome of the triggering step and the predetermined number of the play steps.

15. A gaming system, comprising:

a regulated gaming machine primarily dedicated to playing at least one casino wagering game, the gaming machine including an electronic display device and one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

in response to a base-game triggering event during the base game, conduct a multi-level bonus game of the casino wagering game, the conducted bonus game including a plurality of played levels, the plurality of played levels including a main level and a plurality of nested levels, each of the played levels including one or more play steps, each of the nested levels being triggered by a respective bonus-game triggering step among the one or more play steps in the main level or another of the nested levels;

in response to a total number of the play steps in all of the played levels exceeding a predetermined number, store in a memory device, (i) play step replay data enabling display of the outcome of each bonus-game triggering step and the predetermined number of the play steps including the last chronological play steps played in the conducted bonus game,and (ii) summary data enabling display of a summary screen for each of the played levels;

retrieve from the memory device, (i) the replay data to reproduce and display the outcome of each bonus-game triggering step and the predetermined number of the play steps, and (ii) the summary data to display the summary screen for each of the nested levels;

generate and display, by the electronic display device, the outcome of the bonus-game triggering steps and the play steps of the bonus game based upon the replay data, and the summary screen for each of the nested levels; and receive, via at least one of the one or more electronic input devices, a cashout input that initiates a payout from the credit balance.

16. The gaming system of claim 15, wherein the play steps include at least one of free spins of symbol-bearing reels or player selections from a pick field.

17. The gaming system of claim 15, wherein the one or more nested levels include first and second nested levels, at least one of the play steps in the first nested level being a second bonus-game triggering step that triggers the second nested level, and wherein the replay data enables display of the outcome of the second triggering step.

18. The gaming system of claim 15, wherein the summary data includes the number of play steps in the respective played level, the number of play steps summarized for the respective played level, and a number of credits awarded during the summarized play steps for the respective played level.

19. The gaining system of claim 15, wherein the replay data includes at least one of (i) graphics data related to display images of the outcome of the triggering step of each played level and the predetermined number of the play steps, or (ii) outcome data for reproducing the display images of the outcome of the triggering step and the predetermined number of the play steps.

20. The gaming system of claim 15, wherein the outcome of the bonus-game triggering step, the play steps of the bonus game based upon the replay data, and the summary screen for the one or more of the played levels are generated and displayed, by the electronic display device, in the same chronological order in which the play steps occurred during the wagering game.

* * * * *